US011566305B2

(12) United States Patent
Takebe et al.

(10) Patent No.: US 11,566,305 B2
(45) Date of Patent: Jan. 31, 2023

(54) TITANIUM PLATE

(71) Applicant: NIPPON STEEL CORPORATION, Tokyo (JP)

(72) Inventors: Hidenori Takebe, Tokyo (JP); Kentaroh Yoshida, Tokyo (JP); Atsuhiko Kuroda, Tokyo (JP); Kouichi Takeuchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 32 days.

(21) Appl. No.: 17/041,806

(22) PCT Filed: Apr. 3, 2018

(86) PCT No.: PCT/JP2018/014313
§ 371 (c)(1),
(2) Date: Sep. 25, 2020

(87) PCT Pub. No.: WO2019/193655
PCT Pub. Date: Oct. 10, 2019

(65) Prior Publication Data

US 2021/0025031 A1 Jan. 28, 2021

(51) Int. Cl.

| | |
|---|---|
| ***C22C 14/00*** | (2006.01) |
| ***B21B 1/22*** | (2006.01) |
| ***B21B 3/00*** | (2006.01) |

(52) U.S. Cl.
CPC ..... *C22C 14/00* (2013.01); *B21B 1/22* (2013.01); *B21B 3/00* (2013.01)

(58) Field of Classification Search
CPC ... B21B 1/22; B21B 3/00; C22C 14/00; C22F 1/183
(Continued)

(56) References Cited

U.S. PATENT DOCUMENTS

| | | | | |
|---|---|---|---|---|
| 4,908,072 | A | 3/1990 | Taki et al. | |
| 10,900,109 | B2 * | 1/2021 | Mitsuda | C22F 1/183 |

(Continued)

FOREIGN PATENT DOCUMENTS

| | | |
|---|---|---|
| EP | 3 467 139 A1 | 4/2019 |
| JP | 1-159364 A | 6/1989 |

(Continued)

OTHER PUBLICATIONS

"Theory and practice of flat rolling", The Iron and Steel Institute of Japan, 2010, pp. 33-36.

(Continued)

*Primary Examiner* — Jie Yang
(74) *Attorney, Agent, or Firm* — Birch, Stewart, Kolasch & Birch, LLP

(57) ABSTRACT

A titanium plate includes a chemical composition of industrial pure titanium, in which an arithmetic mean roughness Ra of a surface is 0.05 μm or more and 0.40 μm or less, the surface has titanium carbide regarding which a ratio between a total sum of integrated intensities Ic derived from the titanium carbide and a total sum of integrated intensities Im of all diffraction peaks derived from the titanium carbide and titanium obtained from X-ray diffractometry ((Ic/Im)×100) is 0.8% or more and 5.0% or less, a number density of asperities on the surface is 30 to 100 pieces/mm, and an average spacing of the asperities is 20 μm or less.

4 Claims, 2 Drawing Sheets

(58) Field of Classification Search
USPC ..... 420/419
See application file for complete search history.

(56) References Cited

U.S. PATENT DOCUMENTS

| | | | | |
|---|---|---|---|---|
| 2003/0168133 | A1* | 9/2003 | Kaneko | C25D 11/26 148/518 |
| 2005/0284544 | A1 | 12/2005 | Yamamoto et al. | |
| 2012/0088185 | A1 | 4/2012 | Maeda et al. | |
| 2019/0032182 | A1 | 1/2019 | Mitsuda et al. | |
| 2019/0226073 | A1* | 7/2019 | Takebe | C22F 1/183 |
| 2019/0300996 | A1* | 10/2019 | Mitsuda | C22F 1/18 |

FOREIGN PATENT DOCUMENTS

| | | | |
|---|---|---|---|
| JP | 2006-9115 | A | 1/2006 |
| JP | 2008-88455 | A | 4/2008 |
| JP | 2010-248570 | A | 11/2010 |
| JP | 2011-20135 | A | 2/2011 |
| JP | 2012-186176 | A | 9/2012 |
| JP | 2016-169428 | A | 9/2016 |
| KR | 10-2012-0026387 | A | 3/2012 |
| WO | WO 2017/126017 | A1 | 7/2017 |
| WO | WO 2018/008151 | A1 | 1/2018 |

OTHER PUBLICATIONS

"Marine Corrosion and Biofouling Protection Technology," Huazhong University of Science and Technology, Apr. 2017, pp. 131-132 (6 pages total).

Chinese Office Action issued in the corresponding Chinese Application No. 201880091873.4, dated Feb. 8, 2022.

* cited by examiner

TITANIUM PLATE

TECHNICAL FIELD

The present invention relates to a titanium plate.

BACKGROUND ART

A titanium plate is a metal material excellent in corrosion resistance, and thus is used for a heat exchanger using seawater, various chemical plants, and so on. Further, the titanium plate has a high specific strength, so that it is also utilized as a structural member.

In particular, when the titanium plate is used for a small-sized component, there is a case where surface treatment is performed on the titanium plate in order to impart various characteristics. For example, since titanium cannot exhibit sufficient corrosion resistance in an alkaline environment, by making the titanium plate to be subjected to plating of resin or metal such as Ni having a resistance to alkali corrosion, it becomes possible to utilize the titanium plate also in the alkaline environment. Further, by making the titanium plate to be subjected to plating of metal such as Al, ceramic such as AlN, resin, or the like with different rigidity, it is possible to use the titanium plate as a diaphragm for speaker in which a sound quality is controlled. It is possible to impart, other than the above, various characteristics such as thermal conductivity and abrasion resistance to the titanium plate, which enables to manufacture highly functional products.

However, titanium forms a passive film of $TiO_2$ on a surface thereof, so that deficiency of adhesiveness with a surface treatment coating film is a problem, and particularly, in surface treatment performed for the purpose of imparting conductivity, it is important to sufficiently secure the adhesiveness with the surface treatment coating film. As above, in order to provide the aforementioned various highly functional products, improvement of adhesiveness between a coating layer (surface coating layer) and a base material is an important task.

A large number of inventions for improving adhesiveness between a surface coating layer formed through plating or the like and a base material, have been disclosed so far.

Patent Document 1 discloses an invention in which hot-dip aluminum plating is performed on titanium beforehand, to thereby improve adhesiveness between a coating layer at the uppermost surface and a base material (including the pre-formed plating layer).

Patent Document 2 discloses an invention in which, for the purpose of performing noble metal plating, C and N on a surface of a material to be plated are cleaned, to thereby improve adhesiveness between a noble metal plating layer and the material to be plated.

Patent Document 3 discloses an invention in which graphite is pressure-bonded to a base material, to thereby physically perform graphite coating on a surface of the base material.

Patent Document 4 discloses an invention in which titanium carbonitride is formed on a surface through cold working and annealing, to thereby improve a corrosion resistance.

Regarding a reaction with a rolling oil during cold rolling and the like related to the invention disclosed in Patent Document 4, Non-Patent Document 1 discloses an analysis method regarding a stress and a frictional force generated among a rolling roll, a lubricating oil, and a material to be rolled in a rolling process.

Besides, Patent Document 5 discloses a technique in which a rolling-altered layer that includes titanium carbide (TiCx) is formed by rolling, and by an anchoring effect provided by the layer, adhesiveness with a carbon film to be formed thereafter is improved.

PRIOR ART DOCUMENT

Patent Document

Patent Document 1: Japanese Laid-open Patent Publication No. 2006-009115

Patent Document 2: Japanese Laid-open Patent Publication No. 2008-088455

Patent Document 3: Japanese Laid-open Patent Publication No. 2012-186176

Patent Document 4: Japanese Laid-open Patent Publication No. H1-159364

Patent Document 5: Japanese Laid-open Patent Publication No. 2010-248570

Non-Patent Document

Non-Patent Document 1: Edited by Rolling Theory Committee, The lion and Steel Institute of Japan: "Theory and practice of flat rolling" (2010), The Iron and Steel Institute of Japan, pp. 33-36

DISCLOSURE OF THE INVENTION

Problems to be Solved by the Invention

However, in the inventions disclosed in Patent Documents 1 to 5 and the method disclosed in Non-Patent Document 1, it is not possible to surely provide a titanium plate excellent in adhesiveness between a surface coating layer and a base material, and workability, while suppressing an increase in treatment cost.

An object of the present invention is to provide a titanium plate excellent in adhesiveness with a surface coating layer, and workability.

Means for Solving the Problems

The present inventors repeatedly conducted earnest studies for solving the above-described problems, and consequently, they obtained findings (A) to (G) listed below and completed the present invention.

(A) Although it is possible to improve the adhesiveness of the film by the anchoring effect provided by forming asperities on the surface of the titanium plate by utilizing the titanium carbide (TiCx) disclosed in Patent Document 5, the anchoring effect is not sufficient. Further, since workability of the titanium plate is not taken into consideration at all, there remains a problem regarding deterioration of workability due to the titanium carbide.

(B) By controlling cold rolling conditions of the titanium plate, it is possible to obtain uniform adhesiveness without relying only on the anchoring effect provided by the titanium carbide.

(C) If normal cold rolling is performed, a hardened layer having the titanium carbide and the like formed thereon, of a surface layer of the titanium plate, is cracked in an irregular manner, resulting in that uniformly distributed asperities cannot be obtained. On the other hand, when, at a time of performing cold rolling of plural passes on a titanium hot-rolled plate, strong reduction or reduction using a dull roll is performed and/or rolling with dull roll is properly performed in a pass before a rolling final pass by two passes or three passes (indicating an (N-2)-th pass or an (N-3)-th pass when the final pass is set to an N-th pass), the hardened layer of the surface layer of the titanium plate is cracked uniformly.

(D) Aside from the above-described problems, there is a case where, at a time of rolling a titanium plate, titanium is deposited on a surface of a work roll, resulting in that an indentation flaw is generated on the titanium plate to form a large dent portion. The aforementioned large dent formed during the rolling is relatively deep, so that the dent may become a starting point of crack when performing working thereafter.

If, in the last or the second last pass (indicating the N-th pass or the (N-1)-th pass when the final pass is set to the N-th pass) in cold rolling, the rolling is performed by exchanging the work roll to a smooth one, a new crack is difficult to occur in the last or the second last pass, and meanwhile, it is possible to reduce the depth of crack introduced by the strong reduction or the reduction with dull roll right before the rolling final pass. This makes it possible to suppress a deep crack on the surface of the titanium plate being the base material, and to form asperities with a uniform distribution, resulting in that the adhesiveness between the surface coating layer and the base material can be improved.

(F) In the cold rolling, the operation is performed to make a lubricating oil uniformly enter a roll bite, and by making a hardened layer on the surface composed of titanium carbide formed on the surface of the titanium plate to be formed as uniformly as possible, it becomes possible to more uniformly form cracks on the surface hardened layer by the strong reduction and/or the rolling with dull roll.

(G) As described above, by controlling the cold rolling conditions, it is possible to control a number density of asperities and an average spacing (width) of the asperities on the surface of the titanium plate to fall within predetermined ranges, resulting in that the adhesiveness of the surface coating film can be uniformized.

The present invention completed based on such findings (A) to (G) are as described below.

A titanium plate includes a chemical composition comprising: in mass %, Fe: 0.00 to 0.20%; O: 0.00 to 0.12%; N: 0.00 to 0.08%; C: 0.00 to 0.10%; H: 0.000 to 0.013%; Al: 0.00 to 0.50%; Cu: 0.00 to 0.50%; Si: 0.00 to 0.30%; Cr: 0.00 to 0.50%; Ni: 0.00 to 0.50%; Mo: 0.00 to 0.50%; V: 0.00 to 0.50%; Nb: 0.00 to 0.50%; Sn: 0.00 to 0.50%; Co: 0.00 to 0.50%; Zr: 0.00 to 0.50%; Mn: 0.00 to 0.50%; Ta: 0.00 to 0.50%; W: 0.00 to 0.50%; Hf: 0.00 to 0.50%; Pd: 0.00 to 0.50%; Ru: 0.00 to 0.50%; and the balance: Ti and impurities, in which an arithmetic mean roughness Ra of a surface is 0.05 μm or more and 0.40 μm or less, the surface has titanium carbide regarding which a ratio between a total sum of integrated intensities Ic derived from the titanium carbide and a total sum of integrated intensities Im of all diffraction peaks derived from the titanium carbide and titanium obtained from X-ray diffractometry ((Ic/Im)×100) is 0.8% or more and 5.0% or less, a number density of asperities on the surface is 30 to 100 pieces/mm, and an average spacing of the asperities is 20 μm or less.

In the titanium plate, it is also possible that Cr+Ni+Mo+V+Nb: 0.00 to 1.00% in mass %, is satisfied. Further, it is also possible that Sn+Co+Zr+Mn+Ta+W+Hf+Pd+Ru: 0.00 to 1.00% in mass %, is satisfied. Further, it is also possible that in a surface layer at a depth of 0.1 μm to 0.5 μm from the surface, a carbon content measured by using XPS is 10.0 at % or more. Further, it is also possible that a ratio between a characteristic X-ray (Kα-ray) intensity from the surface and a Kα-ray intensity in graphite obtained by an EPMA at an acceleration voltage of 10 kV is 1.00% or more.

Effect of the Invention

According to the present invention, it is possible to provide a titanium plate excellent in adhesiveness with a surface coating layer and workability.

EMBODIMENTS FOR CARRYING OUT THE INVENTION

Figure 1:
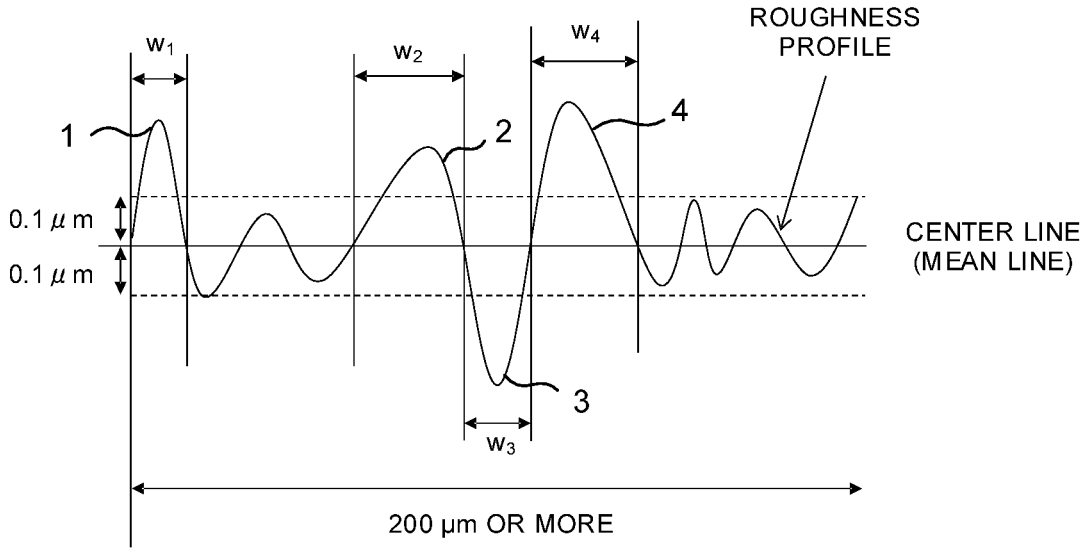
FIG. 1 is an explanatory view illustrating one example of a roughness profile at a surface of a titanium plate according to the present invention.

1. Chemical Composition of Titanium Plate According to Present Invention

It can be said that a chemical composition of a titanium plate according to the present embodiment is composed of, in mass %, Fe: 0.20% or less, O: 0.12% or less, N: 0.08% or less, C: 0.10% or less, H: 0.013% or less, and the balance: Ti and impurities. "%" regarding the chemical composition to be described below means "mass %" unless otherwise noted.

As the titanium plate according to the present invention, there can be cited, for example, titanium (also referred to as industrial pure titanium) of a first type to a fourth type defined by JIS H4600 (2012), titanium of Grades 1 to 4 defined by ASTM B265 corresponding thereto, and titanium defined by 3.7025, 3.7035, 3.7055 standardized by DIN 17850.

(1-1) Fe: 0.00 to 0.20%

When an Fe content is increased, a β phase is generated, and since a fine structure is obtained due to the β phase, workability is impaired. For this reason, the Fe content is 0.20% or less, desirably 0.15%, and more desirably 0.10% or less. On the other hand, a lower limit of the Fe content is 0.00%. However, Fe is inevitably contained from an industrial standpoint, so that the lower limit of the Fe content may be 0.01%, 0.02%, or 0.03%.

(1-2) O: 0.00 to 0.12%

O increases strength of the titanium plate, but, at the same time, it greatly reduces the workability. For this reason, the O content is 0.12% or less, desirably 0.10% or less, and more desirably 0.08% or less. On the other hand, a lower limit of the O content is 0.00%. However, 0 is inevitably contained from an industrial standpoint, so that the lower limit of the O content may be 0.01%, 0.02%, or 0.03%.

(1-3) N: 0.00 to 0.08%

N also reduces the workability of the titanium plate, similarly to O. For this reason, the N content is 0.08% or less, desirably 0.05% or less, and more desirably 0.03% or less. On the other hand, a lower limit of the N content is 0.00%. However, N is inevitably contained from an industrial standpoint, so that the lower limit of the N content may be 0.01%, 0.02%, or 0.03%.

(1-4) C: 0.00 to 0.10%

An influence of C exerted on the strength and the workability is smaller than that of 0 and N. However, when considering that O and N are contained, an upper limit of the C content is 0.10%, desirably 0.08% or less, and more desirably 0.03% or less. On the other hand, a lower limit of the C content is 0.00%. However, C is inevitably contained from an industrial standpoint, so that the lower limit of the C content may be 0.01%, 0.02%, or 0.03%.

H: 0.000 to 0.013%

H is an element that causes embrittlement, and a solubility limit thereof in room temperature is approximately 10 ppm, so that when H whose content is equal to or more than the limit is contained, there is a concern that hydride is formed to cause embrittlement. Generally, if the content of H is 0.013% or less, H is employed with no practical problem although there is the concern regarding the embrittlement. The H content is preferably 0.010% or less, and more preferably 0.008% or less, 0.006% or less, 0.004% or less, or 0.003% or less. A lower limit of the H content is 0.000%. If circumstances require, the lower limit of the H content may be 0.001%, 0.002%, or 0.003%.

(1-5) Metal Elements Derived From Scrap

When utilization of scrap as a raw material is promoted, in addition to the above-described elements (Fe, O, N, C, H), metal elements other than these elements are mixed. If strict management is performed, it is possible to prevent the mixing of these elements, but, a treatment cost for realizing that is increased. In the present invention, in order to provide an inexpensive titanium plate, the mixing of metal elements derived from scrap is allowed as much as possible in a range in which the effect of the present invention is not impaired. The metal elements derived from scrap include Al, Cu, Cr, Ni, Mo, V, Sn, Co, Zr, Nb, Si, Mn, Ta, W, Hf, Pd, Ru, and so on.

(1-5-1) Al: 0.00 to 0.50%

Al does not promote the generation of β phase, but, it reduces the workability. For this reason, the Al content is 0.50% or less, desirably 0.40% or less, and more desirably 0.30% or less.

(1-5-2) Cu: 0.00 to 0.50%

Cu does not reduce the workability so much when compared to Al. For this reason, the Cu content is 0.50% or less, desirably 0.40% or less, and more desirably 0.30% or less.

(1-5-3) Si: 0.00 to 0.30%

Si exerts a greater influence on the workability than Al, so that the Si content is 0.30% or less, desirably 0.20% or less, and more desirably 0.15% or less.

(1-5-4) Cr: 0.00 to 0.50%, Ni: 0.00 to 0.50%, Mo: 0.00 to 0.50%, V: 0.00 to 0.50%, Nb: 0.00 to 0.50%, Cr+Ni+Mo+V+Nb: 0.00 to 1.00%

Cr, Ni, Mo, V, Nb strongly promote the generation of β phase, similarly to Fe. For this reason, each of contents of Cr, Ni, Mo, V, Nb is 0.50% or less, and a total of the contents of Cr, Ni, Mo, V, Nb is 1.00% or less, desirably 0.80% or less, and more desirably 0.60% or less.

(1-5-5) Sn: 0.00 to 0.50%, Co: 0.00 to 0.50%, Zr: 0.00 to 0.50%, Mn: 0.00 to 0.50%, Ta: 0.00 to 0.50%, W: 0.00 to 0.50%, Hf: 0.00 to 0.50%, Pd: 0.00 to 0.50%, Ru: 0.00 to 0.50%, Sn+Co+Zr+Mn+Ta+W+Hf+Pd+Ru: 0.00 to 1.00%

Sn, Co, Zr, Mn, Ta, W, Hf, Pd, Ru do not reduce the workability so much when compared to Al. For this reason, each of contents of Sn, Co, Zr, Mn, Ta, W, Hf, Pd, Ru is set to 0.50% or less, and a total of the contents is 1.00% or less, desirably 0.80% or less, and more desirably 0.60% or less.

(1-6) Balance

The balance other than the above is composed of Ti and impurities.

Note that a bulk component (chemical composition) of the titanium plate is expressed by an analytical value analyzed as follows. Specifically, a sample for component analysis is collected from a product plate, Fe and the other contained metals are expressed by analytical values obtained by Inductively Coupled Plasma (ICP) Atomic Emission Spectroscopy, O is expressed by an analytical value obtained by Inert Gas Fusion Infrared Absorption Method, N is expressed by an analytical value obtained by Inert Gas Fusion Thermal Conductivity Method, and C is expressed by an analytical value obtained by High Frequency Combustion Infrared Absorption Method. Regarding the analysis of C, in order to eliminate the influence of C adhered to the vicinity of the surface, there is a need to perform analysis in a range of ¼ to ¾ in a plate thickness from the surface. However, when analyzing the other elements, there is no problem if the entire plate thickness is used.

2. Arithmetic Mean Roughness Ra of Surface of Titanium Plate According to Present Invention As will be described later, even if a number density and a width of asperities on the surface of the titanium plate are controlled, when a depth of the asperities is deep (when a level difference is large), this becomes a starting point of stress concentration to cause fracture. Further, it also becomes difficult to obtain a smooth surface when performing surface treatment on the titanium plate. For this reason, it is effective to reduce the roughness of the surface of the titanium plate. From such a viewpoint, an arithmetic mean roughness Ra of the surface of the titanium plate according to the present invention is 0.40 μm or less, and more desirably 0.30 μm or less. Further, a lower limit of the arithmetic mean roughness Ra is 0.05 μm or more in order to sufficiently obtain the anchoring effect. The arithmetic mean roughness Ra is a value defined by JIS B 0601: 2001, and is determined from a primary profile of evaluated surface measured in a direction perpendicular to a rolling direction in a rolled surface of the titanium plate. As a procedure thereof, at first, a primary profile measured by a laser type measuring device using a violet laser with a wavelength of 408 nm, at 500 measurement magnifications (a visual field is about 300 μm square), at a pitch of 0.1 μm in a Z direction, and with a beam diameter of 0.1 μm or less, is filtered based on a cut-off value λc=0.08 mm, to thereby obtain a roughness profile. Regarding the obtained roughness profile, the arithmetic mean roughness Ra is determined. Note that an evaluation length (reference length) at this time is about 300 μm (to be accurate, 298 μm). Further, since there is a case where variations occur in the measurement of one visual field, an average value of measured values at five places (visual fields) is used.

3. Number Density and Average Spacing of Asperities on Surface of Titanium Plate According to Present Invention FIG. 1 is an explanatory view illustrating one example of a roughness profile at the surface of the titanium plate according to the present invention.

As illustrated in FIG. 1, asperities (profile valleys and profile peaks) that exist on the surface of the titanium plate according to the present invention are fine cracks. The number density and the average spacing (also referred to as an asperity width) of the fine dents (profile valleys) and bumps (profile peaks) are important for improvement of uniform coating film adhesiveness. Titanium carbide (TiCx)

exists in the bumps and the dents. The bumps are formed when the hardened layer of the surface layer of the titanium plate is cracked by the cold rolling of strong reduction or the dull roll.

In the present invention, as illustrated in FIG. 1, a profile peak with a height of 0.1 μm or more from a center line (mean line) being a straight line drawn to minimize a square sum of deviation with the roughness profile decided based on the cut-off value of 0.08 mm, is defined as a bump (also referred to as the profile peak). Further, a profile valley with a depth of 0.1 μm or more from the center line (mean line) is defined as a dent (also referred to as the profile valley). Further, the number density of the bumps and the dents (also referred to as the number density of asperities) is defined as the number of the bumps and the dents (the profile peaks and the profile valleys) existing in a length of 1 mm of the roughness profile, and the average spacing of the bumps and the dents (also referred to as the asperity width) is defined as an average value of widths of the bumps and the dents (the profile peaks and the profile valleys). This is because there is an effect such that a coating film formed on the surface of the titanium plate enters even the dents to improve the adhesiveness due to the anchoring effect, and the anchoring effect is small in the profile peak with a height of less than 0.1 μm and the profile valley with a depth of less than 0.1 μm. When description is made by citing FIG. 1 as an example, the number of profile peaks or profile valleys of 0.1 μm or more from the center line, appeared in a measurement range (200 μm or more) in FIG. 1, and contributing to the anchoring effect, are four denoted by reference numerals 1 to 4 (profile peaks 1, 2, 4, and a profile valley 3). Further, the asperity width is an average value (W1+W2+W3+W4)/4 of lengths of the center lines cut by the profile peaks 1, 2, 4 (W1, W2, W4 in FIG. 1) and a length of the center line cut by the profile valley 3 (W3 in FIG. 1).

Figure 2:
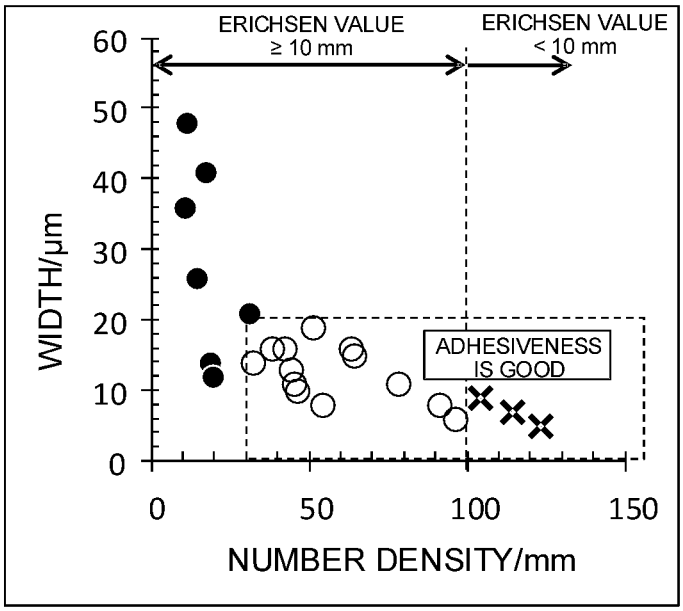
FIG. 2 is a graph illustrating a relation between adhesiveness and asperities.

FIG. 2 is a graph illustrating a relation between the adhesiveness and asperities. A white circle plot "○" in the graph of FIG. 2 indicates that the adhesiveness is good, and an Erickson value is 10 mm or more, and a black circle plot "●" indicates that the adhesiveness is inferior. Further, a plot "x" indicates that the Erichsen value becomes less than 10 mm.

As illustrated in the graph of FIG. 2, the excellent adhesiveness is provided when the number density is 30 pieces/mm or more, and the average spacing (asperity width) is 20 μm or less. The reason why the adhesiveness becomes more excellent as the number of bumps and dents existing on the surface of the titanium plate and having a certain degree of width increases, is because a physical anchoring effect is promoted. An upper limit of the average spacing (asperity width) may be 17 μm, 15 μm, or 13 μm. However, if the asperity width is excessively narrow, at a time of forming the coating film, the coating film becomes difficult to enter the dent, resulting in that the anchoring effect cannot be obtained. For this reason, a lower limit of the average spacing (asperity width) is preferably 5 μm, but, it may also be 8 μm, 10 μm, or 12 μm.

It can be considered that the larger the number density of the bumps and the dents is, the more the adhesiveness with the coating film is improved, and when starting points of stress concentrations increase, the formability is improved. However, when increasing the number density, there is a need to form a larger amount of hardened layer of the surface layer, which reduces the Erickson value. When the number density is approximately 100 pieces/mm or more, the Erickson value becomes less than 10 mm. For this reason, the number density of the bumps and the dents is 30 pieces/mm or more and 100 pieces/mm or less, desirably 30 pieces/mm or more and 90 pieces/mm or less, and more desirably 30 pieces/mm or more and 80 pieces/mm or less. An upper limit of the number density of the bumps and the dents may be 70 pieces/mm, 60 pieces/mm, or 50 pieces/mm. This is because, when the number density is less than 30 pieces/mm, the coating film formed on the surface of the titanium plate is difficult to enter the dent, resulting in that it becomes difficult to obtain the anchoring effect.

4. Carbon Amount on Surface of Titanium Plate According to Present Invention

In order to effectively form asperities which are effective for the anchoring effect, it is preferable to perform surface hardening with the use of carbon, before forming the asperities. For this reason, the surface of the titanium plate after forming the asperities satisfying the aforementioned number density of asperities and asperity width, contains carbon whose amount is larger than that in a center portion of a plate thickness. For example, it is preferable that carbon of 10 at % or more on average is contained in a region at a depth of 0.1 μm to 1.0 μm from the surface of the titanium plate. Carbon in this region may also be 12 atm % or more, 15 atm % or more, or 17 atm % or more on average. Further, carbon in this region may also be 32 atm % or less, 30 atm % or less, or 28 atm % or less on average. The carbon amount is analyzed by repeatedly conducting measurement of element amount a plurality of times using sputtering and XPS (X-ray photoelectron spectroscopy). Note that a depth position in the XPS is managed based on a distance at which $SiO_2$ is sputtered by Ar ions, so that the average carbon amount may be 10 atm % or more at a depth of 0.1 μm to 0.5 μm from the surface in terms of the $SiO_2$ converted distance. Specifically, Ar sputtering (a sputtering rate: 1.9 nm/min in $SiO_2$ conversion) is performed to a depth of 0.1 μm in terms of the $SiO_2$ converted distance from the surface, a sample surface (a surface sputtered to a depth of 0.1 μm) is irradiated with a monochromatic Al Kα X-ray with a beam diameter of 200 μm, a carbon amount is measured by using photoelectrons obtained by the irradiation, and after that, the sputtering and the measurement are repeatedly conducted to a depth of 0.5 μm in terms of the $SiO_2$ converted distance from the surface at a pitch of 0.1 to 0.2 μm in terms of the $SiO_2$ converted distance, and an average value of carbon amounts obtained at respective depths is determined. Note that as elements other than carbon, nitrogen, oxygen, and titanium are set as essential, and an element detected by a qualitative analysis is also subjected to measurement in a similar manner Carbon on the surface layer of the titanium plate is supplied from a rolling oil, and introduced only to an outermost surface layer (a range of a depth of 1 μm or less from the surface, for example) of the titanium plate by cold rolling with respect to the surface layer. The degree of hardening is different depending on a solid-solution amount of carbon regarding solid-solution strengthening, and depending on a working amount regarding work hardening. In the work hardening, deformation is concentrated on a soft portion, so that the soft portion is preferentially hardened. However, a sufficiently uniform effect is not provided only by the work hardening, so that by reducing the soft portion with the use of carbon, titanium carbide, and the like, it is possible to further reduce the soft portion in the work hardening. For this reason, by the solid-solution strengthening realized by carbon that exists in the surface layer, the surface layer of the titanium plate is highly strengthened, by performing working, the surface layer is hardened by the working, and the surface layer is hardened in an approximately uniform manner by a synergistic effect with the titanium carbide formed on the surface layer of the titanium plate.

When the surface layer is uniformly hardened, fine cracks uniformly occur when performing cold rolling, resulting in that desired asperities are uniformly formed on the surface. As described above, it can be considered that when the surface layer contains carbon, nonuniform hardening due to the working is mitigated. For this reason, it is desirable that the surface layer of the titanium plate after forming asperities thereon also contains a large amount of carbon. Carbon that is introduced into the surface layer during working can be evaluated by an EPMA (Electron Probe Micro Analyzer). There is no problem if the evaluation by the EPMA is performed in an as-cold-rolled state or after annealing. This is because an evaluation range of the EPMA is about 1 to 2 μm of the surface layer, and diffusion of carbon to the inside during the annealing approximately falls within this range.

In the EPMA, an annealed plate is subjected to ultrasonic cleaning using acetone, and measurement is performed thereafter. The evaluation of the carbon amount is expressed by an intensity ratio when intensity of characteristic X-ray Kα of a standard sample is set to 100%. Graphite (having a purity of 99.9% or more, and a relative density of sintered compact (density of sintered compact/ideal density) of 99% or more) is set to be used as the standard sample. The measurement is performed in an area of 40000 $\mu m^2$ or more at an acceleration voltage of 10 kV. The measurement of the graphite standard sample and the sample is performed through plane analysis. Intensities at respective points are determined with a beam diameter set to 1 μm or less, at a 2 μm pitch, and with an irradiation time of 50 ms/point, and an average intensity thereof is employed. Note that an irradiation current is set to 5 nA when measuring the standard sample, it is set to 20 nA when measuring the sample, and the intensity of the standard sample is converted to a level same as that of the measurement at 20 nA by quadrupling the obtained value. The obtained intensity ratio is preferably 1.00% or more, and more preferably 1.30% or more, 1.50% or more, or 2.00% or more. On the other hand, when the amount of carbon is excessively high, carbon forms a large amount of titanium carbide when being annealed, to thereby reduce the formability after the annealing. The intensity ratio is preferably 5.00% or less, and it may also be 4.70% or less, or 4.50% or less.

Carbon on the surface of the titanium plate forms the titanium carbide through the annealing, so that it can be identified by X-ray diffractometry. In the X-ray diffractometry, a value obtained by a ratio between a total sum of integrated intensities Ic derived from the titanium carbide and a total sum of integrated intensities Im of all diffraction peaks derived from the titanium carbide and titanium (Ic/Im×100) is only required to be 0.8% or more. A curve of diffraction peak obtained by using a Cu Kα X-ray as the X-ray, and by setting a measurement step angle (2θ) to 0.06° in a θ/2θ method, is subjected to smoothing (a weighted average method at nine points) and background processing (Sonnevelt-Visser method), and a diffraction peak corresponding to Kα1 obtained after removing a diffraction peak due to Kα2 by setting an intensity ratio Kα2/Kα1 between Kα1 and Kα2 to 0.497, is used. Note that the diffraction peaks of titanium carbide are those of (111), (200), (220) planes, and diffraction peaks of Ti are all diffraction peaks of α-Ti observed in a range where 2θ is 30° to 130°.

Figure 3:
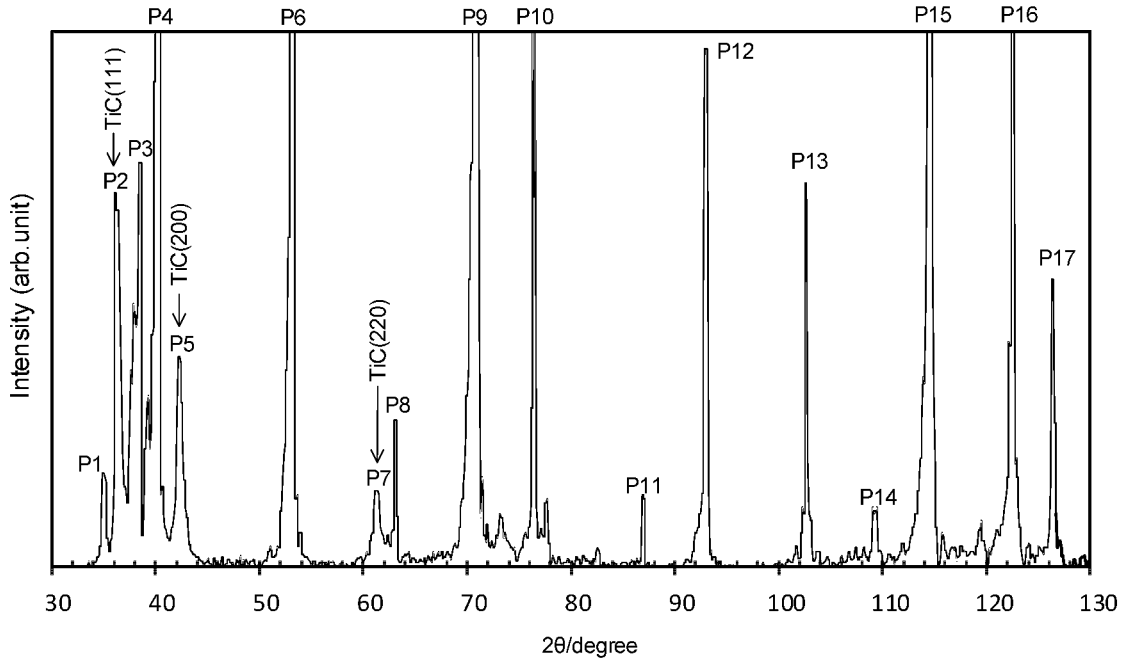
FIG. 3 is a graph illustrating integrated intensities (diffraction peak values) obtained from X-ray diffractometry at the surface of the titanium plate.

FIG. 3 illustrates an example of an X-ray diffractometry pattern. Among diffraction peaks of P1 to P17, diffraction peaks of titanium carbide are P2, P5, P7, and integrated intensities of the diffraction peaks are I(111), I(200), I(220), respectively. A ratio between the total sum of these integrated intensities Ic=I(111)+I(200)+I(220) and a total sum of integrated intensities Im of all diffraction peaks (P1 to P17) derived from titanium (Ic/Im×100) is determined. Note that although there are small diffraction peaks in the vicinity of 2θ=73°, 78°, the diffraction peaks are smaller than the other diffraction peaks and are not considered as diffraction peaks of titanium carbide, so that a large influence is not exerted on the results, and thus the diffraction peaks are not required to be taken into consideration. The judgment regarding the diffraction peak which is not taken into consideration, is made based on whether or not an integrated intensity of the diffraction peak becomes 5% or less of Ic. Only the diffraction peaks at the positions described in FIG. 3 may be taken into consideration.

When considering a surface carbon amount in order not to significantly reduce the formability, an abundance of titanium carbide on the surface of the titanium plate after forming the asperities thereon (Ic/Im×100) is 0.8% or more and 5.0% or less. This is because, when the titanium carbide of more than 5.0% is detected, the surface layer of the titanium plate is excessively hardened, which causes a problem in the formability of the titanium plate. A preferable upper limit of the abundance of the titanium carbide (Ic/Im×100) may also be 4.0%, 3.5%, 3.0%, or 2.5%. Further, a lower limit of the abundance of the titanium carbide (Ic/Im×100) is 0.8%, and the lower limit may also be 1.0%, 1.5%, or 2.0%. Note that in the present invention, by considering a balance between the formability of the titanium plate and the improvement of adhesiveness of the titanium plate with a coating layer, a surface hardness is preferably 200 or more and 300 or less in terms of a Vickers hardness HV0.025. An upper limit of the Vickers hardness HV0.025 may also be 270, 260, or 250. Further, a lower limit of the Vickers hardness HV0.025 may also be 210, 220, or 230. Regarding the measurement of the Vickers hardness, 10 points are randomly measured at a load of 25 gf, in a manner that mutual impressions are separated by a distance corresponding to a size of five impressions or more on a plate surface, and evaluation is made based on an average value of the measurement.

Note that in an as-cold-rolled state, TiCx exists in the vicinity of a vertex of the bump, and it does not exist in the dent. However, the rolling oil which cannot be removed by cleaning remains in the dent, and forms TiCx in annealing. Further, since carbon is diffused to the inside in the annealing, a carbon distribution when forming asperities by heavy reduction and a carbon distribution after the annealing are different. The depth of asperities effective for the adhesiveness is 0.1 μm or more, so that if sufficient carbon does not exist in a region of 0.1 μm or more from the plate surface, it is not possible to form desired asperities during the cold rolling. Besides, if the diffusion of carbon due to the annealing is also taken into consideration, in a case where the carbon amount at 0.1 μm to 0.5 μm from the surface after the annealing is evaluated and when a value of the carbon amount is 10 at % or more, desired asperities are obtained, so that the carbon amount at 0.1 μm to 0.5 μm from the surface is required to be 10 at % or more.

5. One Example of Manufacturing Method of Titanium Plate According to Present Invention A titanium plate is manufactured in a manner that a titanium cast slab is hot-rolled, annealed thereafter according to need, and further cold-rolled. The titanium plate according to the present invention can be manufactured by performing a first step and a second step to be described below in cold rolling. Further, a final annealing step (third step) and shape correction may also be further performed according to need after the cold rolling.

Note that when titanium of a first type or a second type defined by JIS H4600 (2012) and excellent in formability is formed to be a thin plate by cold rolling, the cold rolling at a reduction ratio of greater than 80% is generally performed. However, when the cold rolling at the reduction ratio of greater than 80% is performed at a time of manufacturing a product with a small plate thickness of less than 0.3 mm, there is a concern that a surface crack occurs nonuniformly, to thereby impair the formability of the product. For this reason, when manufacturing a product having a plate thickness of less than 0.3 mm, it is desirable to perform the cold rolling at a reduction ratio in a range of 80% or less. Further, intermediate annealing is sometimes required in accordance with a plate thickness of a hot-rolled plate and a plate thickness of a product. The intermediate annealing at this time is performed in a continuous mode or a batch mode in a range of 600 to 800° C. In the batch mode, an atmosphere is a vacuum or Ar gas atmosphere, but, in the continuous mode, the annealing is sometimes performed in the air, and after performing the annealing in the air, descaling has to be performed by pickling. After the descaling, a final rolling step (final cold rolling step) is performed. Note that when the intermediate annealing is performed in the air, a surface is removed by the pickling, so that carbon or the like adhered to the surface due to the rolling so far is also removed. It is a matter of course that in the vacuum or Ar gas atmosphere, carbon remains on the surface. Note that the intermediate annealing is often required when the plate thickness is 0.3 mm or less. However, when a hot-rolled plate with a plate thickness of greater than 0.3 mm and 1.5 mm or less is used, the intermediate annealing is not required.

(5-1) First and Second Steps (Final Cold Rolling Step)

The first step is a step that is performed for the purpose of forming asperities on the surface. The first step corresponds to a rolling pass as a result of removing a final pass in a final cold rolling step to be performed on a hot-rolled plate or a titanium plate after being subjected to the intermediate annealing, or a rolling pass as a result of removing the final pass and a pass previous to the final pass. Specifically, the first step indicates, in the final cold rolling step of N passes, from a first pass to an (N-1)-th pass or from the first pass to an (N-2)-th pass. The second step is a step that is performed for the purpose of performing final adjustment of asperities and shape correction of the plate. When the first step is from the first pass to the (N-1)-th pass, only the final pass (N-th pass) of the final cold rolling step corresponds to the second step. On the other hand, when the first step is from the first pass to the (N-2)-th pass, the final two passes (the (N-1)-th pass, and the N-th pass) correspond to the second step. In an initial pass in general cold rolling, since the plate is soft, a reduction ratio is high, and the rolling is performed at a reduction ratio of about 20% or less per one pass. When the rolling progresses further, hardening occurs due to work hardening, and it becomes difficult to keep a good shape due to reduced plate thickness, so that the rolling is performed at a reduction ratio of about 10% or less per one pass. On the other hand, in the present invention, strong reduction is performed in the last pass or the last two passes in the first step (a pass before the final pass by two passes, or passes before the final pass by two passes and three passes, in the final cold rolling step), with respect to the hardened plate. Specifically, the strong reduction is performed in the (N-2)-th pass in the final cold rolling step of N passes. Alternatively, the strong reduction is performed in the (N-2)-th pass and the (N-3)-th pass in the final cold rolling step of N passes. In the strong reduction in this case, a reduction ratio between passes is required to be set to 15% or more. Note that the rolling at a reduction ratio of 20% or less is preferably performed in order not to cause excessive cracks. Specifically, a maximum interpass reduction ratio between the final two passes in the first step is only required to be 15% or more. Further, when a rolling roll with large surface roughness (surface-controlled roll) such as a dull roll is used, a shape of the roll is transferred to the plate, so that the shape of the roll is set to have an asperity shape to be formed on the plate in the present invention. This is because the asperities become shallow due to reduction in shape correction unless the shape of the asperities is set to a shape deeper than a desired asperity shape. Accordingly, it is required to perform strong reduction also in this case, and there is a need to sufficiently transfer asperities on the roll surface, to a plate surface. For this reason, in a situation of this strong reduction, it is preferable to use a roll whose number density of bumps and dents is 30 pieces/mm or more, and whose average spacing of bumps and dents (asperity width) is 20 μm or less.

Figure 4:
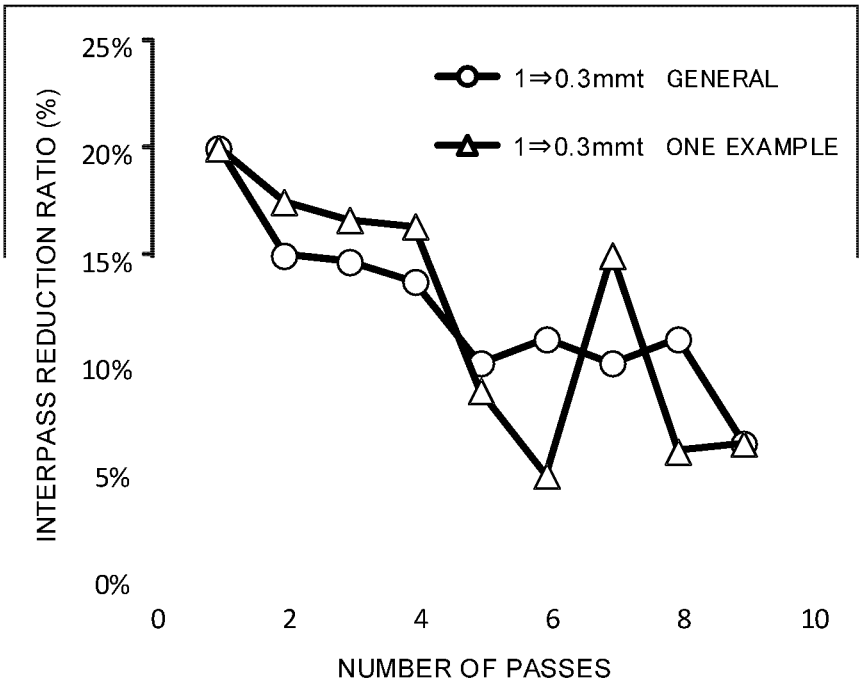
FIG. 4 is an explanatory view in which a pass schedule of general cold rolling and one example of a pass schedule for manufacturing the titanium plate of the present invention are illustrated by being compared to each other.

In the second step, final adjustment of asperities and shape correction of plate are performed in the final pass or a pass previous to the final pass in the final cold rolling step. This is performed for the purpose of correcting the shape deteriorated by the strong reduction (at a reduction ratio of 15% or more) performed in the first step and adjusting the asperity shape formed in the first step. Note that as the deteriorated shape, undulation of the plate, occurrence of wrinkling, and the like can be exemplified. Further, to adjust the asperity shape means that, the bumps of asperities formed in the first step are lowered (to less than 0.1 μm) by reduction in the second step, to thereby mainly reduce the number density of asperities. In the second step, an influence is exerted also on the asperity width, but, the influence is less than that on the number density. A rolling roll used in the second step desirably controls a surface roughness thereof. Since asperities of the rolling roll are transferred to the plate, it is desirable to set at least Ra to 0.4 μm or less. Although the surface roughness of the plate after being subjected to rolling does not always correspond to the surface roughness of the roll, it is preferable to set Ra to 0.4 μm or less as much as possible. When a roll whose Ra exceeds 0.4 μm is used, there is a need to keep in mind a point that the shape correction becomes difficult since it is required to reduce a reduction ratio in a rolling pass for the shape correction. Note that since a lower limit of Ra is 0.05 μm, a lower limit of the roughness of the roll is also desirably 0.05 μm. This is because, if the roughness is less than the lower limit, the depth of asperities becomes excessively small, resulting in that the number density of asperities effective for the anchoring effect cannot satisfy the predetermined range. As an example of the rolling, reduction ratios between respective passes are illustrated in FIG. 4. A pass schedule in FIG. 4 is an example in which a plate obtained by making a hot-rolled plate to be subjected to cold rolling to 1 mmt, then air annealing at 700° C. for 2 min, and descaling through pickling, is used as a raw material. In general cold rolling (circle plot "○"), an initial reduction ratio becomes large, and the reduction ratio is reduced as the rolling progresses. On the other hand, in one example of a manufacturing method described in this embodiment (triangle plot "Δ"), the strong reduction at 15% is performed in the second last pass (a seventh pass), which corresponds to the first step. The last two passes (an eighth pass and a ninth pass) whose reduction ratios are small, are passes that perform the shape correction for reducing the change in shape caused by the first step, and correspond to the second step.

In the cold rolling of the first and second steps, it is desirable that surfaces of respective roll and titanium plate are uniformly brought into contact with each other, and even working is applied in the rolling of any pass. This is because, if the roll and the titanium plate are locally brought into contact with each other, deformation becomes nonuniform due to a difference in the degree of working when compared to the periphery, which may cause a defective shape in the rolling. Further, this is because, when the working is not performed uniformly, it becomes difficult to obtain the asperities with desired number density and average spacing, in a manner that the asperities obtained by formed cracks are dispersed nonuniformly, and the depth of the asperities becomes deep.

In order to uniformly perform working in the cold rolling of the first and second steps, it is preferable to make a rolling oil uniformly spread across the surface of the titanium plate, and it is only required to properly control viscosity and a supply amount of the rolling oil. The rolling oil may be a general cold rolling oil (mineral oil), and a kinematic viscosity thereof (at 40° C.) is about 8 to 15 $mm^2/s$. It is only required that the rolling oil is supplied to the entire region of a contact width when a material to be rolled and a rolling roll are brought into contact with each other, and the supply amount is desirably set according to a supply method (a supply position, the number of supply ports, and the like).

(5-2) Third Step (Final Annealing Step)

In order to maintain the surface (asperities) formed in the cold rolling, it is effective to select an annealing method capable of maintaining the surface state. The annealing in the third step may be performed in a continuous mode or a batch mode, as long as the annealing is performed in an inert atmosphere (for example, BA: Bright Annealing). However, when a plate thickness is small, particularly, when a plate thickness is less than 0.3 mm, the annealing has to be performed in the continuous mode. This is because, since the annealing in the batch mode is performed by putting a coil on a hearth, an edge is buckled to greatly impair the shape. The annealing is preferably performed at an annealing temperature of 600° C. or more in order to obtain formability. If the annealing temperature is less than 600° C., a worked structure remains to lower the formability of the titanium plate. An upper limit of the annealing temperature is set to 800° C. The reason thereof is because, when the annealing temperature exceeds 800° C., carbon is diffused to enlarge a hardened region of the surface layer, resulting in that the workability deteriorates. A suitable range of an annealing time is 30 s to 2 min.

(5-3) Shape Correction

During the annealing, warpage sometimes occurs due to an influence of tension or the like. In such a case, shape correction is performed after the annealing. In that case, the shape correction is performed according to need, by taking care that the predetermined surface (the asperities with desired number density and average spacing) can be obtained. Note that as the plate thickness of the titanium plate according to the present invention, 0.05 to 1.0 mm can be exemplified.

6. Coating Film to be Formed on Surface of Titanium Plate According to Present Invention A coating film to be formed on the surface of the titanium plate according to the present invention, is formed on the surface having the asperities formed thereon as described above. The coating film is selected according to purposes, and is formed on a titanium plate worked into a predetermined shape, for example. When the titanium plate is used in a state of a flat plate, the coating film is formed on the surface of the titanium plate cut in a predetermined size.

For example, titanium has low resistance to an alkaline environment, so that by coating Ni or resin having high resistance to the alkaline environment on the surface of the titanium plate, it is possible to manufacture a titanium plate having alkali resistance equal to that of Ni and the resin.

Further, when coating resin on the surface of the titanium plate, it is also possible to manufacture a vibration plate that controls a sound quality by controlling a damping capacity.

When a metal having conductivity or a coating film having conductivity is formed on the surface of the titanium plate, it is also possible to prevent dust or the like absorbed by static electricity from being adhered to the titanium plate.

Metals such as Al and Cu, and ceramic such as AlN and SiC have large heat conductivities, so that by coating these on the surface of the titanium plate, it is possible to improve heat conductivity of a conventional titanium plate. On the contrary, by coating a material having small heat conductivity such as zirconia on the surface of the titanium plate, it is possible to improve heat resistance of the titanium plate. Further, by coating hard ceramics on the surface of the titanium plate, it is possible to improve abrasion resistance of the titanium plate.

7. Formation Method of Coating Film

The coating film may be formed through any method such as a PVD (Physical Vapor Deposition) method, a CVD (Chemical Vapor Deposition) method, paste coating, and a baking method. It is effective to clean the surface of the titanium plate before forming the coating film. This is for preventing occurrence of gasification at an interface between the coating film on the surface and a base material due to a substance adhered to the surface, and for preventing the substance from being a starting point of peeling.

EXAMPLES

Next, Examples of the present invention will be described, and the conditions in Examples are one condition example adopted to confirm the practicability and effects of the present invention, and the present invention is not limited to the one condition example. The present invention can adopt various conditions as long as the object of the present invention is achieved without departing from the gist of the present invention as described above.

Tables 1, 2 show chemical compositions of respective titanium plates No. 1 to No. 55 prepared in Examples (No. 1 to No. 30, and No. 45 to No. 52 are examples of the present invention, and No. 31 to No. 44, and No. 53 to No. 55 are comparative examples). Note that each chemical composition indicates components of a cold-rolled plate after annealing Tables 3, 4 show manufacturing conditions of the respective titanium plates No. 1 to No. 55 prepared in Examples. Tables 5, 6 show evaluation results of the respective titanium plates No. 1 to No. 55 prepared in Examples.

TABLE 1

| COMPOSITION | No. | CLASSIFICATION | CHEMICAL COMPOSITION (mass %) | | | | | | | | | |
|---|---|---|---|---|---|---|---|---|---|---|---|---|
| | | | Fe | O | C | N | H | Ni | Cr | Sn | V | Al |
| a | 1 | INVENTION | 0.04 | 0.06 | 0.01 | 0.01 | 0.0042 | <0.01 | <0.01 | <0.01 | <0.01 | <0.01 |
| a | 2 | INVENTION | 0.04 | 0.06 | 0.01 | 0.01 | 0.0042 | <0.01 | <0.01 | <0.01 | <0.01 | <0.01 |
| a | 3 | INVENTION | 0.04 | 0.06 | 0.01 | 0.01 | 0.0042 | <0.01 | <0.01 | <0.01 | <0.01 | <0.01 |
| b | 4 | INVENTION | 0.03 | 0.06 | 0.005 | 0.008 | 0.0041 | <0.01 | <0.01 | <0.01 | <0.01 | <0.01 |
| b | 5 | INVENTION | 0.03 | 0.06 | 0.005 | 0.008 | 0.0041 | <0.01 | <0.01 | <0.01 | <0.01 | <0.01 |
| b | 6 | INVENTION | 0.03 | 0.06 | 0.005 | 0.008 | 0.0041 | <0.01 | <0.01 | <0.01 | <0.01 | <0.01 |
| c | 7 | INVENTION | 0.04 | 0.03 | 0.005 | 0.01 | 0.0041 | <0.01 | <0.01 | <0.01 | <0.01 | <0.01 |
| c | 8 | INVENTION | 0.04 | 0.03 | 0.005 | 0.01 | 0.0041 | <0.01 | <0.01 | <0.01 | <0.01 | <0.01 |
| c | 9 | INVENTION | 0.04 | 0.03 | 0.005 | 0.01 | 0.0041 | <0.01 | <0.01 | <0.01 | <0.01 | <0.01 |
| c | 10 | INVENTION | 0.04 | 0.03 | 0.005 | 0.01 | 0.0041 | <0.01 | <0.01 | <0.01 | <0.01 | <0.01 |
| c | 11 | INVENTION | 0.04 | 0.03 | 0.005 | 0.01 | 0.0041 | <0.01 | <0.01 | <0.01 | <0.01 | <0.01 |
| c | 12 | INVENTION | 0.04 | 0.03 | 0.005 | 0.01 | 0.0041 | <0.01 | <0.01 | <0.01 | <0.01 | <0.01 |
| c | 13 | INVENTION | 0.04 | 0.03 | 0.005 | 0.01 | 0.0041 | <0.01 | <0.01 | <0.01 | <0.01 | <0.01 |
| c | 14 | INVENTION | 0.04 | 0.03 | 0.005 | 0.01 | 0.0041 | <0.01 | <0.01 | <0.01 | <0.01 | <0.01 |
| 1 | 15 | INVENTION | 0.04 | 0.06 | 0.1 | 0.007 | 0.0047 | <0.01 | <0.01 | <0.01 | <0.01 | <0.01 |
| 2 | 16 | INVENTION | 0.06 | 0.12 | 0.02 | 0.005 | 0.0049 | <0.01 | <0.01 | <0.01 | <0.01 | <0.01 |
| 3 | 17 | INVENTION | 0.05 | 0.05 | 0.03 | 0.005 | 0.0124 | <0.01 | <0.01 | <0.01 | <0.01 | <0.01 |
| 4 | 18 | INVENTION | 0.06 | 0.05 | 0.02 | 0.006 | 0.0038 | 0.50 | <0.01 | <0.01 | <0.01 | <0.01 |
| 5 | 19 | INVENTION | 0.07 | 0.07 | 0.005 | 0.007 | 0.0033 | <0.01 | 0.50 | <0.01 | <0.01 | <0.01 |
| 6 | 20 | INVENTION | 0.05 | 0.06 | 0.007 | 0.02 | 0.0037 | <0.01 | <0.01 | 0.50 | <0.01 | <0.01 |
| 7 | 21 | INVENTION | 0.05 | 0.05 | 0.006 | 0.011 | 0.0044 | <0.01 | <0.01 | <0.01 | 0.50 | <0.01 |
| 8 | 22 | INVENTION | 0.06 | 0.05 | 0.006 | 0.008 | 0.0041 | <0.01 | <0.01 | <0.01 | <0.01 | 0.50 |
| 9 | 23 | INVENTION | 0.04 | 0.05 | 0.005 | 0.006 | 0.003 | <0.01 | <0.01 | <0.01 | <0.01 | <0.01 |
| 10 | 24 | INVENTION | 0.04 | 0.04 | 0.004 | 0.08 | 0.0038 | <0.01 | <0.01 | <0.01 | <0.01 | <0.01 |
| 11 | 25 | INVENTION | 0.03 | 0.06 | 0.007 | 0.007 | 0.0051 | <0.01 | <0.01 | <0.01 | <0.01 | <0.01 |
| 12 | 26 | INVENTION | 0.13 | 0.06 | 0.003 | 0.008 | 0.0035 | <0.01 | <0.01 | <0.01 | <0.01 | <0.01 |
| 13 | 27 | INVENTION | 0.2 | 0.1 | 0.005 | 0.006 | 0.0037 | <0.01 | <0.01 | <0.01 | <0.01 | <0.01 |

| COMPOSITION | CHEMICAL COMPOSITION (mass %) | | | | | | | | | | | |
|---|---|---|---|---|---|---|---|---|---|---|---|---|
| | Si | Cu | Nb | Zr | Mo | Co | Mn | Ta | W | Hf | Pd | Ru |
| a | <0.01 | <0.01 | <0.01 | <0.01 | <0.01 | <0.01 | <0.01 | <0.01 | <0.01 | <0.01 | <0.01 | <0.01 |
| a | <0.01 | <0.01 | <0.01 | <0.01 | <0.01 | <0.01 | <0.01 | <0.01 | <0.01 | <0.01 | <0.01 | <0.01 |
| a | <0.01 | <0.01 | <0.01 | <0.01 | <0.01 | <0.01 | <0.01 | <0.01 | <0.01 | <0.01 | <0.01 | <0.01 |
| b | <0.01 | <0.01 | <0.01 | <0.01 | <0.01 | <0.01 | <0.01 | <0.01 | <0.01 | <0.01 | <0.01 | <0.01 |
| b | <0.01 | <0.01 | <0.01 | <0.01 | <0.01 | <0.01 | <0.01 | <0.01 | <0.01 | <0.01 | <0.01 | <0.01 |
| b | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| 1 | <0.01 | <0.01 | <0.01 | <0.01 | <0.01 | <0.01 | <0.01 | <0.01 | <0.01 | <0.01 | <0.01 | <0.01 |
| 2 | <0.01 | <0.01 | <0.01 | <0.01 | <0.01 | <0.01 | <0.01 | <0.01 | <0.01 | <0.01 | <0.01 | <0.01 |
| 3 | <0.01 | <0.01 | <0.01 | <0.01 | <0.01 | <0.01 | <0.01 | <0.01 | <0.01 | <0.01 | <0.01 | <0.01 |
| 4 | <0.01 | <0.01 | <0.01 | <0.01 | <0.01 | <0.01 | <0.01 | <0.01 | <0.01 | <0.01 | <0.01 | <0.01 |
| 5 | <0.01 | <0.01 | <0.01 | <0.01 | <0.01 | <0.01 | <0.01 | <0.01 | <0.01 | <0.01 | <0.01 | <0.01 |
| 6 | <0.01 | <0.01 | <0.01 | <0.01 | <0.01 | <0.01 | <0.01 | <0.01 | <0.01 | <0.01 | <0.01 | <0.01 |
| 7 | <0.01 | <0.01 | <0.01 | <0.01 | <0.01 | <0.01 | <0.01 | <0.01 | <0.01 | <0.01 | <0.01 | <0.01 |
| 8 | <0.01 | <0.01 | <0.01 | <0.01 | <0.01 | <0.01 | <0.01 | <0.01 | <0.01 | <0.01 | <0.01 | <0.01 |
| 9 | 0.30 | <0.01 | <0.01 | <0.01 | <0.01 | <0.01 | <0.01 | <0.01 | <0.01 | <0.01 | <0.01 | <0.01 |
| 10 | <0.01 | 0.50 | <0.01 | <0.01 | <0.01 | <0.01 | <0.01 | <0.01 | <0.01 | <0.01 | <0.01 | <0.01 |
| 11 | <0.01 | <0.01 | 0.50 | <0.01 | <0.01 | <0.01 | <0.01 | <0.01 | <0.01 | <0.01 | <0.01 | <0.01 |
| 12 | <0.01 | <0.01 | <0.01 | 0.50 | <0.01 | <0.01 | <0.01 | <0.01 | <0.01 | <0.01 | <0.01 | <0.01 |
| 13 | <0.01 | <0.01 | <0.01 | <0.01 | <0.01 | <0.01 | <0.01 | <0.01 | <0.01 | <0.01 | <0.01 | <0.01 |

TABLE 2

| COMPOSITION | No. | CLASSIFICATION | CHEMICAL COMPOSITION (mass %) | | | | | | | | | |
|---|---|---|---|---|---|---|---|---|---|---|---|---|
| | | | Fe | O | C | N | H | Ni | Cr | Sn | V | Al |
| b | 28 | INVENTION | 0.03 | 0.06 | 0.005 | 0.008 | 0.0041 | <0.01 | <0.01 | <0.01 | <0.01 | <0.01 |
| b | 29 | INVENTION | 0.03 | 0.06 | 0.005 | 0.008 | 0.0041 | <0.01 | <0.01 | <0.01 | <0.01 | <0.01 |
| b | 30 | INVENTION | 0.03 | 0.06 | 0.005 | 0.008 | 0.0041 | <0.01 | <0.01 | <0.01 | <0.01 | <0.01 |
| a | 31 | COMPARISON | 0.04 | 0.06 | 0.01 | 0.01 | 0.0042 | <0.01 | <0.01 | <0.01 | <0.01 | <0.01 |
| b | 32 | COMPARISON | 0.03 | 0.06 | 0.005 | 0.008 | 0.0041 | <0.01 | <0.01 | <0.01 | <0.01 | <0.01 |
| c | 33 | COMPARISON | 0.04 | 0.03 | 0.005 | 0.01 | 0.0041 | <0.01 | <0.01 | <0.01 | <0.01 | <0.01 |
| a | 34 | COMPARISON | 0.04 | 0.06 | 0.01 | 0.01 | 0.0042 | <0.01 | <0.01 | <0.01 | <0.01 | <0.01 |

TABLE 2-continued

| | | | | | | | | | | | | |
|---|---|---|---|---|---|---|---|---|---|---|---|---|
| b | 35 | COMPARISON | 0.03 | 0.06 | 0.005 | 0.008 | 0.0041 | <0.01 | <0.01 | <0.01 | <0.01 | <0.01 |
| c | 36 | COMPARISON | 0.04 | 0.03 | 0.005 | 0.01 | 0.0041 | <0.01 | <0.01 | <0.01 | <0.01 | <0.01 |
| d | 37 | COMPARISON | 0.04 | 0.03 | 0.005 | 0.01 | 0.0041 | <0.01 | <0.01 | <0.01 | <0.01 | <0.01 |
| e | 38 | COMPARISON | 0.04 | 0.05 | 0.005 | 0.03 | 0.0032 | <0.01 | <0.01 | <0.01 | <0.01 | <0.01 |
| f | 39 | COMPARISON | 0.04 | 0.06 | 0.005 | 0.01 | 0.0053 | <0.01 | <0.01 | <0.01 | <0.01 | <0.01 |
| g | 40 | COMPARISON | 0.04 | 0.05 | 0.01 | 0.04 | 0.005 | <0.01 | <0.01 | <0.01 | <0.01 | <0.01 |
| h | 41 | COMPARISON | 0.04 | 0.06 | 0.005 | 0.01 | 0.0051 | <0.01 | <0.01 | <0.01 | <0.01 | <0.01 |
| i | 42 | COMPARISON | 0.08 | 0.13 | 0.05 | 0.04 | 0.0038 | <0.01 | <0.01 | <0.01 | <0.01 | <0.01 |
| 1 | 43 | COMPARISON | 0.04 | 0.06 | 0.1 | 0.007 | 0.0047 | <0.01 | <0.01 | <0.01 | <0.01 | <0.01 |
| 1 | 44 | COMPARISON | 0.04 | 0.06 | 0.1 | 0.007 | 0.0047 | <0.01 | <0.01 | <0.01 | <0.01 | <0.01 |
| 2 | 45 | INVENTION | 0.03 | 0.04 | 0.005 | 0.004 | 0.0016 | <0.01 | <0.01 | <0.01 | <0.01 | <0.01 |
| 3 | 46 | INVENTION | 0.05 | 0.04 | 0.005 | 0.003 | 0.0034 | <0.01 | <0.01 | <0.01 | <0.01 | <0.01 |
| 4 | 47 | INVENTION | 0.04 | 0.04 | 0.005 | 0.004 | 0.0023 | <0.01 | <0.01 | <0.01 | <0.01 | <0.01 |
| 5 | 48 | INVENTION | 0.03 | 0.03 | 0.006 | 0.005 | 0.0033 | <0.01 | <0.01 | <0.01 | <0.01 | <0.01 |
| 6 | 49 | INVENTION | 0.04 | 0.05 | 0.004 | 0.005 | 0.0037 | <0.01 | <0.01 | <0.01 | <0.01 | <0.01 |
| 7 | 50 | INVENTION | 0.03 | 0.04 | 0.003 | 0.003 | 0.0024 | <0.01 | <0.01 | <0.01 | <0.01 | <0.01 |
| 8 | 51 | INVENTION | 0.03 | 0.04 | 0.006 | 0.003 | 0.0022 | <0.01 | <0.01 | <0.01 | <0.01 | <0.01 |
| 9 | 52 | INVENTION | 0.03 | 0.05 | 0.005 | 0.004 | 0.0027 | <0.01 | <0.01 | <0.01 | <0.01 | <0.01 |
| 10 | 53 | COMPARISON | 0.23 | 0.06 | 0.007 | 0.007 | 0.0024 | <0.01 | <0.01 | <0.01 | <0.01 | <0.01 |
| 11 | 54 | COMPARISON | 0.11 | 0.06 | 0.008 | 0.1 | 0.0029 | <0.01 | <0.01 | <0.01 | <0.01 | <0.01 |
| 12 | 55 | COMPARISON | 0.12 | 0.06 | 0.12 | 0.005 | 0.0031 | <0.01 | <0.01 | <0.01 | <0.01 | <0.01 |

| | CHEMICAL COMPOSITION (mass %) | | | | | | | | | | | |
|---|---|---|---|---|---|---|---|---|---|---|---|---|
| COMPOSITION | Si | Cu | Nb | Zr | Mo | Co | Mn | Ta | W | Hf | Pd | Ru |
| b | <0.01 | <0.01 | <0.01 | <0.01 | <0.01 | <0.01 | <0.01 | <0.01 | <0.01 | <0.01 | <0.01 | <0.01 |
| b | <0.01 | <0.01 | <0.01 | <0.01 | <0.01 | <0.01 | <0.01 | <0.01 | <0.01 | <0.01 | <0.01 | <0.01 |
| b | <0.01 | <0.01 | <0.01 | <0.01 | <0.01 | <0.01 | <0.01 | <0.01 | <0.01 | <0.01 | <0.01 | <0.01 |
| a | <0.01 | <0.01 | <0.01 | <0.01 | <0.01 | <0.01 | <0.01 | <0.01 | <0.01 | <0.01 | <0.01 | <0.01 |
| b | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| a | <0.01 | <0.01 | <0.01 | <0.01 | <0.01 | <0.01 | <0.01 | <0.01 | <0.01 | <0.01 | <0.01 | <0.01 |
| b | <0.01 | <0.01 | <0.01 | <0.01 | <0.01 | <0.01 | <0.01 | <0.01 | <0.01 | <0.01 | <0.01 | <0.01 |
| c | <0.01 | <0.01 | <0.01 | <0.01 | <0.01 | <0.01 | <0.01 | <0.01 | <0.01 | <0.01 | <0.01 | <0.01 |
| d | <0.01 | <0.01 | <0.01 | <0.01 | <0.01 | <0.01 | <0.01 | <0.01 | <0.01 | <0.01 | <0.01 | <0.01 |
| e | <0.01 | <0.01 | <0.01 | <0.01 | <0.01 | <0.01 | <0.01 | <0.01 | <0.01 | <0.01 | <0.01 | <0.01 |
| f | <0.01 | <0.01 | <0.01 | <0.01 | <0.01 | <0.01 | <0.01 | <0.01 | <0.01 | <0.01 | <0.01 | <0.01 |
| g | <0.01 | <0.01 | <0.01 | <0.01 | <0.01 | <0.01 | <0.01 | <0.01 | <0.01 | <0.01 | <0.01 | <0.01 |
| h | <0.01 | <0.01 | <0.01 | <0.01 | <0.01 | <0.01 | <0.01 | <0.01 | <0.01 | <0.01 | <0.01 | <0.01 |
| i | <0.01 | <0.01 | <0.01 | <0.01 | <0.01 | <0.01 | <0.01 | <0.01 | <0.01 | <0.01 | <0.01 | <0.01 |
| 1 | <0.01 | <0.01 | <0.01 | <0.01 | <0.01 | <0.01 | <0.01 | <0.01 | <0.01 | <0.01 | <0.01 | <0.01 |
| 1 | <0.01 | <0.01 | <0.01 | <0.01 | <0.01 | <0.01 | <0.01 | <0.01 | <0.01 | <0.01 | <0.01 | <0.01 |
| 2 | <0.01 | <0.01 | <0.01 | <0.01 | 0.50 | <0.01 | <0.01 | <0.01 | <0.01 | <0.01 | <0.01 | <0.01 |
| 3 | <0.01 | <0.01 | <0.01 | <0.01 | <0.01 | 0.50 | <0.01 | <0.01 | <0.01 | <0.01 | <0.01 | <0.01 |
| 4 | <0.01 | <0.01 | <0.01 | <0.01 | <0.01 | <0.01 | 0.50 | <0.01 | <0.01 | <0.01 | <0.01 | <0.01 |
| 5 | <0.01 | <0.01 | <0.01 | <0.01 | <0.01 | <0.01 | <0.01 | 0.50 | <0.01 | <0.01 | <0.01 | <0.01 |
| 6 | <0.01 | <0.01 | <0.01 | <0.01 | <0.01 | <0.01 | <0.01 | <0.01 | 0.50 | <0.01 | <0.01 | <0.01 |
| 7 | <0.01 | <0.01 | <0.01 | <0.01 | <0.01 | <0.01 | <0.01 | <0.01 | <0.01 | 0.50 | <0.01 | <0.01 |
| 8 | <0.01 | <0.01 | <0.01 | <0.01 | <0.01 | <0.01 | <0.01 | <0.01 | <0.01 | <0.01 | 0.50 | <0.01 |
| 9 | <0.01 | <0.01 | <0.01 | <0.01 | <0.01 | <0.01 | <0.01 | <0.01 | <0.01 | <0.01 | <0.01 | 0.50 |
| 10 | <0.01 | <0.01 | <0.01 | <0.01 | <0.01 | <0.01 | <0.01 | <0.01 | <0.01 | <0.01 | <0.01 | <0.01 |
| 11 | <0.01 | <0.01 | <0.01 | <0.01 | <0.01 | <0.01 | <0.01 | <0.01 | <0.01 | <0.01 | <0.01 | <0.01 |
| 12 | <0.01 | <0.01 | <0.01 | <0.01 | <0.01 | <0.01 | <0.01 | <0.01 | <0.01 | <0.01 | <0.01 | <0.01 |

TABLE 3

| | | | | PLATE THICKNESS AFTER | FINAL COLD ROLLING FIRST STEP SURFACE-CONTROLLED ROLL | |
|---|---|---|---|---|---|---|
| COMPOSITION | No. | CLASSIFICATION | INTERMEDIATE ANNEALING | INTERMEDIATE ANNEALING (mm) | PRESENCE/ ABSENCE | Ra |
| a | 1 | INVENTION | PRESENCE | 2 | ABSENCE | — |
| a | 2 | INVENTION | PRESENCE | 2 | ABSENCE | — |
| a | 3 | INVENTION | PRESENCE | 1 | ABSENCE | — |
| b | 4 | INVENTION | ABSENCE | 4 | ABSENCE | — |
| b | 5 | INVENTION | PRESENCE | 1 | ABSENCE | — |
| b | 6 | INVENTION | PRESENCE | 2 | ABSENCE | — |
| c | 7 | INVENTION | PRESENCE | 2 | ABSENCE | — |
| c | 8 | INVENTION | PRESENCE | 2 | ABSENCE | — |
| c | 9 | INVENTION | ABSENCE | 4 | ABSENCE | — |
| c | 10 | INVENTION | ABSENCE | 4 | ABSENCE | — |
| c | 11 | INVENTION | PRESENCE | 2 | ABSENCE | — |
| c | 12 | INVENTION | PRESENCE | 2 | PRESENCE | 0.35 |

TABLE 3-continued

| | | | | | | |
|---|---|---|---|---|---|---|
| c | 13 | INVENTION | PRESENCE | 2 | PRESENCE | 0.19 |
| c | 14 | INVENTION | PRESENCE | 2 | ABSENCE | — |
| 1 | 15 | INVENTION | PRESENCE | 2 | ABSENCE | — |
| 2 | 16 | INVENTION | PRESENCE | 2 | ABSENCE | — |
| 3 | 17 | INVENTION | PRESENCE | 2 | ABSENCE | — |
| 4 | 18 | INVENTION | PRESENCE | 2 | ABSENCE | — |
| 5 | 19 | INVENTION | PRESENCE | 2 | ABSENCE | — |
| 6 | 20 | INVENTION | PRESENCE | 2 | ABSENCE | — |
| 7 | 21 | INVENTION | PRESENCE | 2 | ABSENCE | — |
| 8 | 22 | INVENTION | PRESENCE | 2 | ABSENCE | — |
| 9 | 23 | INVENTION | PRESENCE | 2 | ABSENCE | — |
| 10 | 24 | INVENTION | PRESENCE | 2 | ABSENCE | — |
| 11 | 25 | INVENTION | PRESENCE | 2 | ABSENCE | — |
| 12 | 26 | INVENTION | PRESENCE | 2 | ABSENCE | — |
| 13 | 27 | INVENTION | PRESENCE | 2 | ABSENCE | — |

| | FINAL COLD ROLLING | | | | | |
|---|---|---|---|---|---|---|
| | FIRST STEP | | SECOND STEP WR CONTROL | | | |
| COMPOSITION | MAXIMUM INTERPASS REDUCTION RATIO BETWEEN FINAL TWO PASSES IN FIRST STEP (%) | TOTAL REDUCTION RATIO (%) | PRESENCE/ ABSENCE | Ra | TOTAL REDUCTION RATIO (%) | PLATE THICKNESS OF COLD-ROLLED PLATE (mm) |
| a | 15.8 | 70 | PRESENCE | 0.34 | 74 | 0.52 |
| a | 17.9 | 80 | ABSENCE | — | 84 | 0.32 |
| a | 20 | 60 | PRESENCE | 0.11 | 68 | 0.32 |
| b | 20 | 90 | PRESENCE | 0.4 | 92 | 0.32 |
| b | 15.9 | 65 | PRESENCE | 0.21 | 73 | 0.27 |
| b | 18.2 | 75 | PRESENCE | 0.1 | 79 | 0.42 |
| c | 15.6 | 75 | PRESENCE | 0.14 | 79 | 0.42 |
| c | 16.7 | 77 | PRESENCE | 0.18 | 81 | 0.38 |
| c | 17.3 | 86 | PRESENCE | 0.08 | 88 | 0.48 |
| c | 20 | 90 | PRESENCE | 0.05 | 92 | 0.32 |
| c | 20 | 70 | PRESENCE | 0.05 | 74 | 0.52 |
| c | 8.6 | 70 | PRESENCE | 0.05 | 74 | 0.52 |
| c | 8.6 | 70 | PRESENCE | 0.05 | 74 | 0.52 |
| c | 15.8 | 70 | ABSENCE | — | 74 | 0.52 |
| 1 | 15.6 | 75 | PRESENCE | 0.05 | 79 | 0.42 |
| 2 | 15.6 | 75 | PRESENCE | 0.1 | 79 | 0.42 |
| 3 | 15.6 | 75 | PRESENCE | 0.1 | 79 | 0.42 |
| 4 | 15.6 | 75 | PRESENCE | 0.1 | 79 | 0.42 |
| 5 | 15.6 | 75 | PRESENCE | 0.1 | 79 | 0.42 |
| 6 | 15.6 | 75 | PRESENCE | 0.1 | 79 | 0.42 |
| 7 | 15.6 | 75 | PRESENCE | 0.1 | 79 | 0.42 |
| 8 | 15.6 | 75 | PRESENCE | 0.1 | 79 | 0.42 |
| 9 | 15.6 | 75 | PRESENCE | 0.1 | 79 | 0.42 |
| 10 | 15.6 | 75 | PRESENCE | 0.1 | 79 | 0.42 |
| 11 | 15.6 | 75 | PRESENCE | 0.1 | 79 | 0.42 |
| 12 | 15.6 | 75 | PRESENCE | 0.1 | 79 | 0.42 |
| 13 | 15.6 | 75 | PRESENCE | 0.1 | 79 | 0.42 |

| | FINAL ANNEALING THIRD STEP | | | SHAPE CORRECTION | |
|---|---|---|---|---|---|
| | ANNEALING | | | | |
| COMPOSITION | TEMPERATURE (° C.) | ANNEALING TIME (min) | METHOD | PRESENCE/ ABSENCE | Ra |
| a | 700 | 2 | BA | PRESENCE | 0.11 |
| a | 700 | 2 | BA | ABSENCE | — |
| a | 800 | 0.2 | BA | PRESENCE | 0.11 |
| b | 620 | 10 | BA | PRESENCE | 0.11 |
| b | 750 | 0.5 | BA | PRESENCE | 0.11 |
| b | 700 | 2 | BA | PRESENCE | 0.11 |
| c | 700 | 2 | BA | ABSENCE | — |
| c | 700 | 2 | BA | PRESENCE | 0.11 |
| c | 700 | 2 | BA | PRESENCE | 0.11 |
| c | 700 | 2 | BA | PRESENCE | 0.11 |
| c | 720 | 0.5 | BA | PRESENCE | 0.11 |
| c | 700 | 2 | BA | PRESENCE | 0.11 |
| c | 700 | 2 | BA | PRESENCE | 0.11 |
| c | 650 | 1 | BA | ABSENCE | — |
| 1 | 700 | 2 | BA | PRESENCE | 0.04 |
| 2 | 700 | 2 | BA | PRESENCE | 0.11 |
| 3 | 700 | 2 | BA | PRESENCE | 0.11 |

TABLE 3-continued

| | | | | | |
|---|---|---|---|---|---|
| 4 | 700 | 2 | BA | PRESENCE | 0.11 |
| 5 | 700 | 2 | BA | PRESENCE | 0.11 |
| 6 | 700 | 2 | BA | PRESENCE | 0.11 |
| 7 | 700 | 2 | BA | PRESENCE | 0.11 |
| 8 | 700 | 2 | BA | PRESENCE | 0.11 |
| 9 | 700 | 2 | BA | ABSENCE | — |
| 10 | 700 | 2 | BA | ABSENCE | — |
| 11 | 700 | 2 | BA | ABSENCE | — |
| 12 | 700 | 2 | BA | ABSENCE | — |
| 13 | 700 | 2 | BA | ABSENCE | — |

TABLE 4

| | | | | PLATE THICKNESS AFTER | FINAL COLD ROLLING FIRST STEP SURFACE-CONTROLLED ROLL | |
|---|---|---|---|---|---|---|
| COMPOSITION | No. | CLASSIFICATION | INTERMEDIATE ANNEALING | INTERMEDIATE ANNEALING (mm) | PRESENCE/ ABSENCE | Ra |
| b | 28 | INVENTION | ABSENCE | 4 | ABSENCE | — |
| b | 29 | INVENTION | ABSENCE | 4 | ABSENCE | — |
| b | 30 | INVENTION | ABSENCE | 4 | ABSENCE | — |
| a | 31 | COMPARISON | ABSENCE | 4 | ABSENCE | — |
| b | 32 | COMPARISON | ABSENCE | 4 | ABSENCE | — |
| c | 33 | COMPARISON | ABSENCE | 4 | ABSENCE | — |
| a | 34 | COMPARISON | ABSENCE | 4 | ABSENCE | — |
| b | 35 | COMPARISON | ABSENCE | 4 | ABSENCE | — |
| c | 36 | COMPARISON | ABSENCE | 4 | ABSENCE | — |
| d | 37 | COMPARISON | ABSENCE | 4 | ABSENCE | — |
| e | 38 | COMPARISON | ABSENCE | 4 | ABSENCE | — |
| f | 39 | COMPARISON | ABSENCE | 4 | ABSENCE | — |
| g | 40 | COMPARISON | ABSENCE | 4 | ABSENCE | — |
| h | 41 | COMPARISON | ABSENCE | 4 | ABSENCE | — |
| i | 42 | COMPARISON | ABSENCE | 4 | ABSENCE | — |
| 1 | 43 | COMPARISON | ABSENCE | 4 | ABSENCE | — |
| 1 | 44 | COMPARISON | PRESENCE | 1 | ABSENCE | — |
| 2 | 45 | INVENTION | PRESENCE | 2 | ABSENCE | — |
| 3 | 46 | INVENTION | PRESENCE | 2 | ABSENCE | — |
| 4 | 47 | INVENTION | PRESENCE | 2 | ABSENCE | — |
| 5 | 48 | INVENTION | PRESENCE | 2 | ABSENCE | — |
| 6 | 49 | INVENTION | PRESENCE | 2 | ABSENCE | — |
| 7 | 50 | INVENTION | PRESENCE | 2 | ABSENCE | — |
| 8 | 51 | INVENTION | PRESENCE | 2 | ABSENCE | — |
| 9 | 52 | INVENTION | PRESENCE | 2 | ABSENCE | — |
| 10 | 53 | COMPARISON | PRESENCE | 2 | ABSENCE | — |
| 11 | 54 | COMPARISON | PRESENCE | 2 | ABSENCE | — |
| 12 | 55 | COMPARISON | PRESENCE | 2 | ABSENCE | — |

| | FINAL COLD ROLLING | | | | | |
|---|---|---|---|---|---|---|
| | FIRST STEP | | | | | |
| COMPOSITION | MAXIMUM INTERPASS REDUCTION RATIO BETWEEN FINAL TWO PASSES IN FIRST STEP (%) | TOTAL REDUCTION RATIO (%) | SECOND STEP WR CONTROL PRESENCE/ ABSENCE | SECOND STEP WR CONTROL Ra | TOTAL REDUCTION RATIO (%) | PLATE THICKNESS OF COLD-ROLLED PLATE (mm) |
| b | 15.3 | 70 | ABSENCE | — | 72 | 1.12 |
| b | 15.3 | 70 | PRESENCE | 0.1 | 72 | 1.12 |
| b | 15.6 | 75 | PRESENCE | 0.1 | 77 | 0.92 |
| a | 27.3 | 86 | PRESENCE | 0.08 | 88 | 0.48 |
| b | 27.3 | 86 | PRESENCE | 0.08 | 88 | 0.48 |
| c | 27.3 | 86 | PRESENCE | 0.1 | 88 | 0.48 |
| a | 11.9 | 65 | PRESENCE | 0.1 | 67 | 1.32 |
| b | 7.5 | 65 | PRESENCE | 0.12 | 67 | 1.32 |
| c | 12.5 | 75 | ABSENCE | — | 77 | 0.92 |
| d | 11.1 | 86 | PRESENCE | 0.11 | 88 | 0.48 |
| e | 5.9 | 86 | ABSENCE | — | 88 | 0.48 |
| f | 15.8 | 70 | ABSENCE | — | 72 | 1.12 |
| g | 15.8 | 70 | ABSENCE | — | 72 | 1.12 |
| h | 15.6 | 75 | PRESENCE | 0.1 | 77 | 0.92 |
| i | 15.6 | 75 | PRESENCE | 0.1 | 77 | 0.92 |
| 1 | 15.6 | 75 | PRESENCE | 0.04 | 77 | 0.92 |

TABLE 4-continued

| | | | | | | |
|---|---|---|---|---|---|---|
| 1 | 15.6 | 75 | PRESENCE | 0.1 | 83 | 0.17 |
| 2 | 15.6 | 75 | PRESENCE | 0.1 | 79 | 0.42 |
| 3 | 15.6 | 75 | PRESENCE | 0.1 | 79 | 0.42 |
| 4 | 15.6 | 75 | PRESENCE | 0.1 | 79 | 0.42 |
| 5 | 15.6 | 75 | PRESENCE | 0.1 | 79 | 0.42 |
| 6 | 15.6 | 75 | PRESENCE | 0.1 | 79 | 0.42 |
| 7 | 15.6 | 75 | PRESENCE | 0.1 | 79 | 0.42 |
| 8 | 15.6 | 75 | PRESENCE | 0.1 | 79 | 0.42 |
| 9 | 15.6 | 75 | PRESENCE | 0.1 | 79 | 0.42 |
| 10 | 15.6 | 75 | PRESENCE | 0.1 | 79 | 0.42 |
| 11 | 15.6 | 75 | PRESENCE | 0.1 | 79 | 0.42 |
| 12 | 15.6 | 75 | PRESENCE | 0.1 | 79 | 0.42 |

| | FINAL ANNEALING THIRD STEP | | | SHAPE CORRECTION | |
|---|---|---|---|---|---|
| | ANNEALING | | | | |
| COMPOSITION | TEMPERATURE (° C.) | ANNEALING TIME (min) | METHOD | PRESENCE/ ABSENCE | Ra |
| b | 700 | 2 | BA | PRESENCE | 0.11 |
| b | 700 | 2 | BA | ABSENCE | — |
| b | 700 | 2 | BA | ABSENCE | — |
| a | 700 | 2 | BA | PRESENCE | 0.11 |
| b | 700 | 2 | BA | PRESENCE | 0.11 |
| c | 700 | 2 | BA | PRESENCE | 0.11 |
| a | 700 | 2 | BA | ABSENCE | — |
| b | 700 | 2 | BA | ABSENCE | — |
| c | 680 | 0.5 | BA | ABSENCE | — |
| d | 700 | 2 | BA | ABSENCE | — |
| e | 700 | 2 | BA | ABSENCE | — |
| f | 700 | 2 | AP | PRESENCE | 0.11 |
| g | 700 | 2 | AP | PRESENCE | 0.11 |
| h | 700 | 2 | AP | PRESENCE | 0.11 |
| i | 700 | 2 | BA | PRESENCE | 0.11 |
| 1 | 700 | 2 | BA | PRESENCE | 0.03 |
| 1 | 700 | 2 | BA | ABSENCE | — |
| 2 | 700 | 2 | BA | PRESENCE | 0.11 |
| 3 | 700 | 2 | BA | PRESENCE | 0.11 |
| 4 | 700 | 2 | BA | PRESENCE | 0.11 |
| 5 | 700 | 2 | BA | PRESENCE | 0.11 |
| 6 | 700 | 2 | BA | PRESENCE | 0.11 |
| 7 | 700 | 2 | BA | PRESENCE | 0.11 |
| 8 | 700 | 2 | BA | PRESENCE | 0.11 |
| 9 | 700 | 2 | BA | PRESENCE | 0.11 |
| 10 | 700 | 2 | BA | PRESENCE | 0.11 |
| 11 | 700 | 2 | BA | PRESENCE | 0.11 |
| 12 | 700 | 2 | BA | PRESENCE | 0.11 |

TABLE 5

| | | | | ELEMENTS OF ASPERITIES | | | |
|---|---|---|---|---|---|---|---|
| COMPOSITION | No. | CLASSIFICATION | ROUGHNESS Ra (μm) | NUMBER DENSITY (PIECES/mm) | WIDTH (μm) | ERICHSEN VALUE (mm) | COATING FILM ADHESIVENESS EVALUATION |
| a | 1 | INVENTION | 0.21 | 56 | 6 | 10.4 | B |
| a | 2 | INVENTION | 0.16 | 68 | 11 | 10.6 | A |
| a | 3 | INVENTION | 0.13 | 64 | 15 | 10.6 | B |
| b | 4 | INVENTION | 0.35 | 63 | 16 | 10.8 | A |
| b | 5 | INVENTION | 0.26 | 45 | 11 | 11.3 | B |
| b | 6 | INVENTION | 0.21 | 44 | 13 | 11.5 | B |
| c | 7 | INVENTION | 0.18 | 32 | 14 | 11.6 | C |
| c | 8 | INVENTION | 0.27 | 42 | 16 | 11.6 | B |
| c | 9 | INVENTION | 0.13 | 98 | 11 | 11.8 | B |
| c | 10 | INVENTION | 0.08 | 64 | 8 | 11.8 | A |
| c | 11 | INVENTION | 0.08 | 46 | 10 | 12.1 | B |
| c | 12 | INVENTION | 0.10 | 51 | 19 | 11.9 | B |
| c | 13 | INVENTION | 0.07 | 91 | 8 | 12.2 | B |
| c | 14 | INVENTION | 0.40 | 47 | 15 | 10.7 | B |
| 1 | 15 | INVENTION | 0.05 | 32 | 16 | 11.9 | C |
| 2 | 16 | INVENTION | 0.17 | 32 | 8 | 10.2 | C |
| 3 | 17 | INVENTION | 0.19 | 33 | 17 | 11.2 | B |
| 4 | 18 | INVENTION | 0.22 | 38 | 12 | 10.8 | B |

TABLE 5-continued

| | | | | | | | |
|---|---|---|---|---|---|---|---|
| 5 | 19 | INVENTION | 0.15 | 34 | 17 | 10.9 | B |
| 6 | 20 | INVENTION | 0.16 | 36 | 16 | 10.5 | C |
| 7 | 21 | INVENTION | 0.17 | 33 | 17 | 11.3 | B |
| 8 | 22 | INVENTION | 0.19 | 31 | 16 | 11.4 | B |
| 9 | 23 | INVENTION | 0.25 | 37 | 14 | 10.9 | B |
| 10 | 24 | INVENTION | 0.26 | 36 | 13 | 10.7 | C |
| 11 | 25 | INVENTION | 0.22 | 35 | 15 | 12.3 | B |
| 12 | 26 | INVENTION | 0.23 | 34 | 14 | 11.8 | C |
| 13 | 27 | INVENTION | 0.21 | 38 | 16 | 10.4 | B |

| COMPOSITION | COATING FILM ADHESIVENESS COATING FILM | XPS SURFACE LAYER C (atm %) | EPMA SURFACE C (%) | Ti CARBIDE Ic/lm (%) | SURFACE HARDNESS $HV_{0.025}$ |
|---|---|---|---|---|---|
| a | C | 18.9 | 1.52 | 0.9 | 266 |
| a | C | 16.2 | 1.18 | 1.9 | 249 |
| a | Ni | 15.3 | 1.32 | 2.1 | 255 |
| b | AlN | 22.4 | 3.97 | 4.7 | 284 |
| b | Ni | 23.8 | 3.88 | 3.8 | 244 |
| b | C | 25.4 | 2.82 | 4.1 | 276 |
| c | Cu | 23.9 | 2.34 | 3.3 | 224 |
| c | Cu | 29.4 | 2.4 | 2.8 | 228 |
| c | C | 31.6 | 3.26 | 4.0 | 264 |
| c | C | 24.9 | 3.61 | 4.3 | 248 |
| c | C | 27.4 | 3.82 | 4.2 | 258 |
| c | Cu | 20.6 | 1.13 | 0.9 | 227 |
| c | Cu | 21.5 | 1.19 | 1.1 | 231 |
| c | C | 24.1 | 1.78 | 2.1 | 241 |
| 1 | Ni | 16.8 | 1.47 | 1.8 | 261 |
| 2 | Ni | 16.2 | 1.52 | 1.7 | 244 |
| 3 | Cu | 14.7 | 1.64 | 2.9 | 248 |
| 4 | Cu | 19.2 | 1.66 | 2.6 | 244 |
| 5 | Ni | 18.7 | 1.43 | 2.4 | 251 |
| 6 | Ni | 11.9 | 1.38 | 2.8 | 246 |
| 7 | C | 18.7 | 1.55 | 2.6 | 241 |
| 8 | C | 21.1 | 1.47 | 2.4 | 247 |
| 9 | AlN | 22.3 | 1.49 | 2.4 | 244 |
| 10 | AlN | 22.7 | 1.54 | 2.1 | 245 |
| 11 | Ni | 14.5 | 1.47 | 1.9 | 253 |
| 12 | Ni | 15.3 | 1.46 | 1.7 | 254 |
| 13 | Cu | 11.7 | 1.49 | 2.4 | 241 |

TABLE 6

| COMPOSITION | No. | CLASSIFICATION | ROUGHNESS Ra (μm) | ELEMENTS OF ASPERITIES NUMBER DENSITY (PIECES/mm) | ELEMENTS OF ASPERITIES WIDTH (μm) | ERICHSEN VALUE (mm) | COATING FILM ADHESIVENESS EVALUATION |
|---|---|---|---|---|---|---|---|
| b | 28 | INVENTION | 0.13 | 39 | 13 | 12.1 | B |
| b | 29 | INVENTION | 0.18 | 41 | 14 | 11.8 | B |
| b | 30 | INVENTION | 0.22 | 44 | 12 | 12.3 | B |
| a | 31 | COMPARISON | 0.13 | 123 | 5 | 9.3 | A |
| b | 32 | COMPARISON | 0.11 | 114 | 7 | 9.4 | A |
| c | 33 | COMPARISON | 0.21 | 104 | 9 | 9.8 | A |
| a | 34 | COMPARISON | 0.31 | 31 | 21 | 11.5 | D |
| b | 35 | COMPARISON | 0.16 | 18 | 28 | 12.4 | D |
| c | 36 | COMPARISON | 0.45 | 10 | 36 | 12.5 | E |
| d | 37 | COMPARISON | 0.12 | 19 | 29 | 12.5 | D |
| e | 38 | COMPARISON | 0.36 | 14 | 26 | 12.6 | E |
| f | 39 | COMPARISON | 0.18 | 17 | 41 | 14.1 | E |
| g | 40 | COMPARISON | 0.16 | 11 | 48 | 14.2 | E |
| h | 41 | COMPARISON | 0.16 | 28 | 18 | 13.9 | D |
| i | 42 | COMPARISON | 0.17 | 32 | 8 | 9.4 | C |
| 1 | 43 | COMPARISON | 0.04 | 21 | 14 | 11.3 | D |
| 1 | 44 | COMPARISON | 0.17 | 39 | 15 | 9.8 | B |
| 2 | 45 | INVENTION | 0.17 | 35 | 16 | 10.6 | B |
| 3 | 46 | INVENTION | 0.16 | 31 | 14 | 10.3 | B |
| 4 | 47 | INVENTION | 0.18 | 42 | 15 | 11.1 | B |
| 5 | 48 | INVENTION | 0.13 | 38 | 14 | 10.6 | B |
| 6 | 49 | INVENTION | 0.14 | 55 | 12 | 10.5 | B |
| 7 | 50 | INVENTION | 0.15 | 54 | 16 | 10.7 | B |
| 8 | 51 | INVENTION | 0.15 | 32 | 18 | 11.3 | B |
| 9 | 52 | INVENTION | 0.18 | 36 | 14 | 10.8 | B |

TABLE 6-continued

| | | | | | | | |
|---|---|---|---|---|---|---|---|
| 10 | 53 | COMPARISON | 0.17 | 32 | 16 | 9.8 | B |
| 11 | 54 | COMPARISON | 0.16 | 36 | 14 | 9.7 | B |
| 12 | 55 | COMPARISON | 0.11 | 34 | 17 | 9.8 | B |

| COMPOSITION | COATING FILM ADHESIVENESS COATING FILM | XPS SURFACE LAYER C (atm %) | EPMA SURFACE C (%) | Ti CARBIDE Ic/Im (%) | SURFACE HARDNESS $HV_{0.025}$ |
|---|---|---|---|---|---|
| b | C | 12.6 | 1.33 | 1.1 | 209 |
| b | C | 10.9 | 1.32 | 1.2 | 209 |
| b | C | 10.6 | 1.38 | 1.3 | 211 |
| a | Ni | 31.5 | 4.15 | 5.4 | 306 |
| b | Ni | 29.8 | 5.32 | 6.9 | 311 |
| c | Ni | 30.2 | 4.66 | 5.2 | 307 |
| a | Cu | 26.8 | 2.13 | 2.7 | 247 |
| b | AlN | 24.1 | 1.49 | 1.8 | 219 |
| c | Ni | 28.8 | 3.45 | 2.8 | 228 |
| d | C | 15.9 | 1.22 | 1.8 | 235 |
| e | C | 8.1 | 0.93 | 0.6 | 239 |
| f | Ni | 2.1 | 0.33 | 0.2 | 135 |
| g | Ni | 1.6 | 0.31 | 0.2 | 134 |
| h | C | 1.8 | 0.47 | 0.4 | 144 |
| i | C | 9.8 | 1.24 | 0.7 | 194 |
| 1 | C | 9.3 | 1.17 | 1.1 | 217 |
| 1 | C | 9.4 | 1.13 | 1.4 | 231 |
| 2 | Ni | 10.3 | 1.13 | 1.2 | 224 |
| 3 | Ni | 10.2 | 1.17 | 1.4 | 231 |
| 4 | Ni | 10.3 | 1.22 | 1.1 | 222 |
| 5 | Ni | 10.5 | 1.27 | 1.2 | 247 |
| 6 | Ni | 10.9 | 1.34 | 1.1 | 241 |
| 7 | Ni | 10.7 | 1.12 | 1.3 | 239 |
| 8 | Ni | 11.6 | 1.47 | 1.5 | 238 |
| 9 | Ni | 13.4 | 1.46 | 1.4 | 242 |
| 10 | Ni | 10.9 | 1.54 | 1.6 | 255 |
| 11 | Ni | 12.6 | 1.14 | 1.4 | 243 |
| 12 | Ni | 13.3 | 1.32 | 1.3 | 221 |

By using a plate of titanium of class 1 defined by JIS H4600 (2012) that was obtained in a manner that a hot-rolled plate with a thickness of 4 mm was descaled, cold-rolled to 1 mm or 2 mm, then subjected to air annealing (intermediate annealing) at 800° C. for 1 min, and then descaled through pickling, cold rolling of 6 to 14 passes (first step) was conducted at a total cold rolling ratio of 50 to 90%. Further, as another condition example, the cold rolling (first step) was conducted by using a descaled hot-rolled plate with a thickness of 4 mm on which the intermediate annealing was not performed. Regarding the respective titanium plates No. 1 to No. 55 prepared in Examples (No. 1 to No. 30, and No. 45 to No. 52 are examples of the present invention, and No. 31 to No. 44, and No. 53 to No. 55 are comparative examples), the presence/absence of the intermediate annealing, and the plate thicknesses after the intermediate annealing are shown in Tables 3, 4. In each of Examples, after performing the first step, shape correction corresponding to the second step (two passes) was performed by repolishing the roll or by using the roll as it is. In Tables 3, 4, a numeric value (%) described in a column of a total reduction ratio in the first step (the rightmost column in the first step), indicates a total reduction ratio (%) in the first step. Further, the presence/absence of use of a rolling roll having a large surface roughness (surface-controlled roll) such as a dull roll in the first step, and a surface roughness Ra of the surface-controlled roll are shown. In Tables 3, 4, a total reduction ratio (%) described in a column immediately to the right of the second step indicates a total of the total reduction ratio (%) in the first step and the total reduction ratio (%) in the second step, and a value obtained by subtracting the total reduction ratio (%) in the first step from the total reduction ratio (%) described in the column immediately right to the second step, becomes the total reduction ratio (%) in the second step. Further, the presence/absence of use of a rolling roll having a large surface roughness (surface-controlled roll) such as a dull roll in the second step, and a surface roughness Ra of the surface-controlled roll are shown. Note that a material of the roll may be any of general high-speed steel, die steel, cemented carbide steel, and the like, and the roll may have coating of CrN or the like on the surface thereof. In Examples, a cemented carbide roll was used. Further, when, after performing the first step, the second step was performed by using the roll as it is without performing repolishing thereon, there was created a state where the surface of the roll was coated with titanium. After that, the cold-rolled plate was subjected to alkaline cleaning to remove an oil content on the surface thereof, and after that, annealing at 600 to 800° C. for 10 minutes at the maximum (third step) was conducted in an Ar atmosphere. In Table 2, an annealing temperature, an annealing time, and a method (BA: Bright Annealing, AP: annealing and pickling) are shown in a column of final annealing (third step). Further, the presence/absence of shape correction, a surface roughness Ra of a roll used for the shape correction are shown in Tables 3, 4.

The annealed cold-rolled plate was cut out in a square of 4 cm, which was used as a substrate and coated with a thin film of Ni, AlN, or C each having a thickness of 2 μm as a surface coating layer. As a film forming method, a sputtering method being one kind of PVD method was used. Further, as thin films, a two-part epoxy resin (E) and conductive epoxy (AE) containing silver added thereto were coated on the surfaces and hardened. Note that a film thickness of the epoxy resin was 100 to 200 μm. In a column of coating film of coating film adhesiveness in Table 3, types of coating films are described regarding the respective titanium plates No. 1 to No. 55 prepared in Examples.

After that, the adhesiveness of these thin films with respect to the substrate was evaluated. The evaluation of the adhesiveness was conducted in accordance with a tape test of JISH8504 standard. In order to strictly evaluate the adhesiveness, the test was performed by forming lattices. Specifically, lattices of 2 mm were formed in a region of the coating film of 2 $cm^2$ to produce 100 grids, an adhesive tape was adhered onto the grids and peeled off, and after that, an adhesive surface of the tape was visually observed, and the presence/absence of adhesion of a peeled film from the substrate was examined. Tables 5, 6 show, regarding the respective titanium plates No. 1 to No. 55 prepared in Examples (No. 1 to No. 30, and No. 45 to No. 52 are examples of the present invention, and No. 31 to No. 44, and No. 53 to No. 55 are comparative examples), an arithmetic mean roughness Ra of the surface (roughness Ra/μm), a number density and an average spacing of asperities on the surface (number density (pieces/mm), and width (μm) in a column of elements of asperities), an Erickson value (/mm), a coating film adhesiveness (evaluation, and coating film), a carbon content measured by using XPS in a surface layer at a depth of 0.1 μm to 0.5 μm from the surface (XPS surface layer C (atm %)), a ratio between a characteristic X-ray (Kα-ray) intensity from the surface and a Kα-ray intensity in graphite obtained by an EPMA at an acceleration voltage of 10 kV (EPMA surface C (%)), a ratio with respect to a total sum of integrated intensities Im of all diffraction peaks derived from titanium carbide and titanium (Ti carbide Ic/Im (%)), and a surface hardness $HV_{0.025}$.

Regarding the evaluation of the coating film adhesiveness, a case where the peeling from the substrate did not occur was evaluated as evaluation A, a case where the number of peeled grids was equal to or less than 10 was evaluated as evaluation B, a case where the number of peeled grids was 11 to 20 was evaluated as evaluation C, a case where the number of peeled grids was 21 to 30 was evaluated as evaluation D, and a case where the number of peeled grids was equal to or greater than 31 was evaluated as evaluation E. A, B, C are acceptable, and D, E are not acceptable. An Erickson test was performed on a test piece of 90 mm square in a manner that a blank holder force was set to 10 kN, a Teflon sheet ("Teflon" is registered trademark) with a thickness of 50 μm was used an a lubricant, a stroke speed of punch was set to 20 mm/min up to when a projection height became 8 mm, and thereafter, the stroke speed of punch was set to 5 mm/min until fracture occurred. The surface roughness is the arithmetic mean roughness Ra defined by JIS B0601: 2001, as described above. The number density and the average spacing of the asperities on the surface employ conditions described above using FIG. 1 and FIG. 2. Note that the roughness of the roll is a result of measurement performed after polishing a material same as that of the roll under a condition same as that of roll polishing. Regarding the surface hardness (Vickers hardness), 10 points were randomly measured at a load of 25 gf in a manner that mutual impressions were separated by a distance corresponding to a size of five impressions or more on a plate surface, and evaluation was made based on an average value of the measurement, as described above. In the XPS, the measurement was performed based on an average carbon amount at a depth of 0.1 to 0.5 μm from the surface in terms of the $SiO_2$ converted distance, as described above. In the EPMA, an intensity ratio when setting an intensity of a characteristic X-ray Kα in a standard sample (graphite) to 100%, was expressed, as described above. A measurement area was set to 500 μm×500 μm.

In the titanium plate having the surface shape defined by the present invention, even if the thin film of any of Ni, AlN, C, the epoxy resin (E), and the conductive epoxy (AE) was coated on the titanium plate, the evaluation results of five stages did not vary. Specifically, with the use of the titanium plate according to the present invention, it is possible to obtain good adhesiveness in any of the metal film, and nonmetals such as the ceramic film and carbon.

The adhesiveness of the surface coating layer in the present invention can be obtained by the anchoring effect ascribable to the predetermined asperity shape on the surface, so that it is possible to improve the adhesiveness not only in the surface coating layer formed by the sputtering method used in present Examples but also in a surface coating layer formed by a plating method, a CVD method, or the like.

No. 1 to No. 30, and No. 45 to No. 52 satisfy all of the conditions defined by the present invention, so that they have not only good adhesiveness but also good workability such that the Erickson value is 10.0 mm or more. In each of No. 12 and No. 13, although the interpass reduction ratio between passes right before finishing in the first step was less than 15%, since the roll whose surface was controlled to have the number density of 30 to 100 pieces/mm and the width of 20 μm or less was used, it was possible to obtain the predetermined asperities.

As illustrated in Tables 5, 6, the number density of the asperities on the surface exerts a large influence on the adhesiveness, and when the number density is 30 or more, the excellent adhesiveness is provided. However, although the number density in each of No. 31 to No. 33 is 30 or more, it exceeds 100, and thus the Erickson value is low. This is because the carbon content on the surface became high due to the performance of rolling at the excessively high reduction ratio in the first step, and in accordance with that, the surface hardness became excessively high. In particular, when the number density of cracks on the surface is large, the rolling oil is likely to remain in gaps, and a large amount of rolling oil remains even after the performance of cleaning step. As a result of this, since carbon whose amount is larger than the amount of carbon adhered to the surface by the rolling exists, the surface hardening occurs during the annealing.

In each of No. 34 to No. 38, since the interpass reduction ratio right before finishing in the first step was less than 15%, the number density and/or the asperity width were/was out of the predetermined range, and thus the adhesiveness was inferior.

In each of No. 39 to No. 41, the air annealing (AP) was performed in the third step and the pickling was conducted, so that it was not possible to obtain the predetermined surface state and the adhesiveness with the coating film was inferior. In No. 42, the oxygen content was large, so that the Erickson value became low. In No. 53, the iron content was large, so that the Erickson value became low. In No. 54, the nitrogen content was large, so that the Erickson value became low. In No. 55, the carbon content was large, so that the Erickson value became low.

In No. 43, the surface roughness of the rolling roll used in the second step was less than 0.05 μm, and Ra of the obtained titanium plate also became less than 0.05 μm, resulting in that the number density of the asperities effective for the anchoring effect was less than 30 pieces/mm, so that the adhesiveness with the coating film was inferior.

In No. 44, the final plate thickness was 0.3 mm or less, and the total reduction ratio in the final cold rolling step exceeded 80%, so that due to the influence of cracks on the surface deepened by the reduced plate thickness, the Erichsen value was less than 10 mm.

What is claimed is:

1. A titanium plate, comprising a chemical composition of a titanium plate body comprising:

in mass %,

Fe: 0.00 to 0.20%;

O: 0.00 to 0.12%;

N: 0.00 to 0.08%;

C: 0.00 to 0.10%;

H: 0.000 to 0.013%;

Al: 0.00 to 0.50%;

Cu: 0.00 to 0.50%;

Si: 0.00 to 0.30%;

Cr: 0.00 to 0.50%;

Ni: 0.0 to 0.50%;

Mo: 0.00 to 0.50%;

V: 0.00 to 0.50%;

Nb: 0.00 to 0.50%;

Sn: 0.00 to 0.50%;

Co: 0.00 to 0.50%;

Zr: 0.00 to 0.50%;

Mn: 0.00 to 0.50%;

Ta: 0.00 to 0.50%;

W: 0.00 to 0.50%;

Hf: 0.00 to 0.50%;

Pd: 0.00 to 0.50%;

Ru: 0.00 to 0.50%; and the balance: Ti and impurities, wherein:

an arithmetic mean roughness Ra of a surface is 0.05 μm or more and 0.40 μm or less, the surface has titanium carbide regarding which a ratio between a total sum of integrated intensities Ic derived from the titanium carbide and a total sum of integrated intensities Im of all diffraction peaks derived from the titanium carbide and titanium obtained from X-ray diffractometry ((Ic/Im)×100) is 0.8% or more and 5.0% or less, a number density of asperities on the surface is 30 to 100 pieces/mm, and an average spacing of the asperities is 20 μm or less;

a plate thickness of the titanium plate is 0.27 mm or more; and in a surface layer at a depth of 0.1 μm to 0.5 μm from the surface, a carbon content measured by using XPS is 10.0 at % or more.

2. The titanium plate according to claim 1, wherein Cr+Ni+Mo+V+Nb: 0.00 to 1.00% in mass %, is satisfied.

3. The titanium plate according to claim 1, wherein Sn+Co+Zr+Mn+Ta+W+Hf+Pd+Ru: 0.00 to 1.00% in mass %, is satisfied.

4. The titanium plate according to claim 1, wherein a ratio between a characteristic X-ray, which is Kα-ray, intensity from the surface and a Kα-ray intensity in graphite obtained by an EPMA at an acceleration voltage of 10 kV is 1.00% or more.

* * * * *